US005647172A

United States Patent [19]

Rokicki

[11] Patent Number: 5,647,172

[45] Date of Patent: Jul. 15, 1997

[54] PULTRUDED FIBERGLASS FRAMING SECTIONS

[76] Inventor: Stanley Rokicki, 112 Lakepromenade, Toronto, Ontario, Canada, M8W 1A4

[21] Appl. No.: 48,590

[22] Filed: Apr. 19, 1993

Related U.S. Application Data

[63] Continuation of Ser. No. 455,190, Dec. 22, 1989, abandoned.

[51] Int. Cl.[6] ..... E06B 1/04

[52] U.S. Cl. ..... 49/504; 49/DIG. 2; 160/381

[58] Field of Search ..... 49/502, 504, DIG. 2; 403/401, 402, 403; 160/381

[56] References Cited

U.S. PATENT DOCUMENTS

| | | | |
|---|---|---|---|
| 3,275,356 | 9/1966 | Heywood | 160/381 |
| 3,472,543 | 10/1969 | Brio | 160/381 |
| 3,836,274 | 9/1974 | Heuschen et al. . | |
| 4,394,338 | 7/1983 | Fuwa . | |
| 4,540,737 | 9/1985 | Wissbrun et al. . | |
| 4,541,884 | 9/1985 | Cogswell et al. . | |
| 4,559,262 | 12/1985 | Cogswell et al. . | |
| 4,564,540 | 1/1986 | Davies et al. . | |
| 4,640,065 | 2/1987 | Harris et al. . | |
| 4,662,110 | 5/1987 | Rokicki . | |
| 4,691,474 | 9/1987 | Rokicki . | |
| 4,720,951 | 1/1988 | Thorn et al. . | |
| 4,726,145 | 2/1988 | Rokicki . | |
| 4,747,248 | 5/1988 | Fahs | 49/504 |
| 4,924,631 | 5/1990 | Davies et al. | 49/DIG. 2 |

FOREIGN PATENT DOCUMENTS

| | | |
|---|---|---|
| 869604 | 4/1971 | Canada . |
| 920310 | 2/1973 | Canada . |
| 945713 | 4/1974 | Canada . |
| 1011612 | 6/1977 | Canada . |
| 1216722 | 1/1987 | Canada . |
| 0022436 | 1/1981 | European Pat. Off. . |
| 156108 | 2/1988 | European Pat. Off. . |
| 2300281 | 7/1974 | Germany . |
| 2545209 | 4/1977 | Germany . |
| 2730633 | 1/1979 | Germany . |
| 2904295 | 8/1979 | Germany . |
| 2818696 | 10/1979 | Germany . |
| 3040625 | 5/1982 | Germany . |
| 3132938 | 3/1983 | Germany . |
| 1522475 | 8/1978 | United Kingdom . |
| 2148963 | 6/1985 | United Kingdom . |

*Primary Examiner*—Michael J. Milano
*Attorney, Agent, or Firm*—Neil H. Hughes; Ivor M. Hughes; Marcelo K. Sarkis

[57] ABSTRACT

A closure assembly is provided assembled from framing sections being fiberglass pultrusions having thin walls, sufficiently thin so as to require reinforcing of the pultrusion proximate the ends and at predetermined positions to allow for (i)joining adjacent pultrusions together and (ii) assembling hardware to the pultrusion, (iii) mounting the pultrusions when assembled in an opening.

61 Claims, 22 Drawing Sheets

FIG. 2A
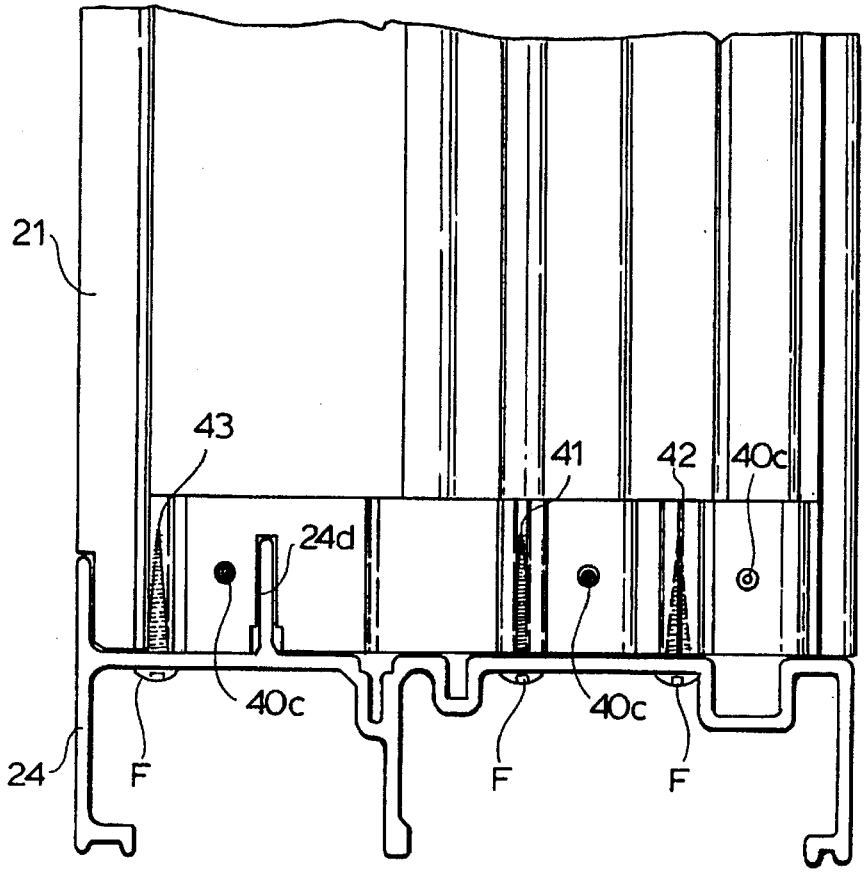
FIG. 16A
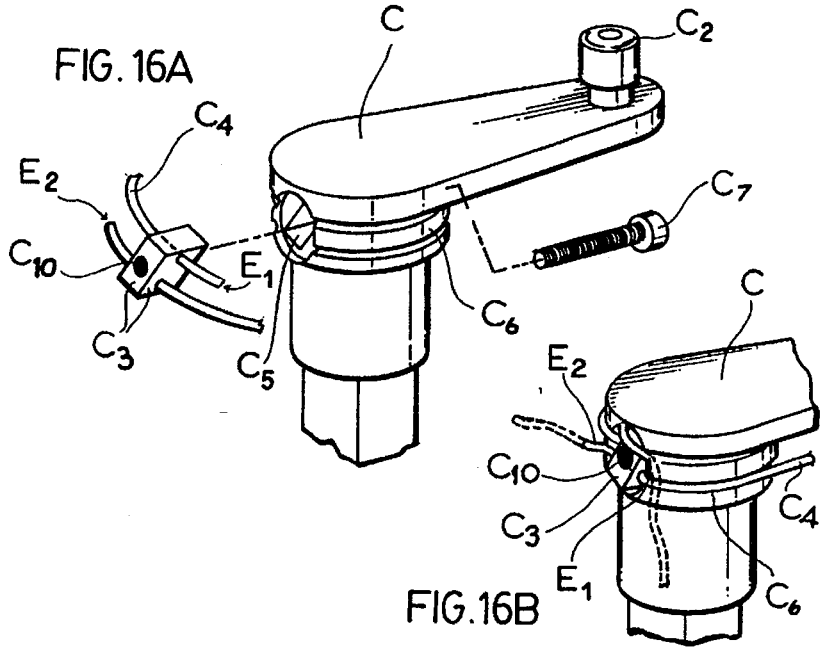
FIG.16B

107XIV
107XV
G9
G10
120
107XIII
G
G1
G8
107
107XII
107x
106XV
107XI
107III
107I

G6
G7
G2
G9
G10
G3
G
G8
G4
G5
G1
106III
106I
H4
H1
106b
H
106a
107b1
H3
H2

107XV
107XVI
107b1
107b1
107b
107XVII
107b1
107III
107c
107I
107
107b

PULTRUDED FIBERGLASS FRAMING SECTIONS

This application is a continuation of U.S. application Ser. No. 07/455,190, filed Dec. 22, 1989, now abandoned.

FIELD OF INVENTION

This invention relates to closure assemblies such as, patio doors and windows, and specifically to those which are manufactured from fiberglass.

BACKGROUND OF THE INVENTION

It is known in the prior art to manufacture portions of closure assemblies such as windows from fiberglass pultrusions.

Canadian Patent 1,216,722 assigned to Dynamit Nobel Ag of the Federal Republic of Germany, teaches a method of forming hollow profiles by extruding glass fibre-reinforced polyvinyl chloride wherein a synthetic resin shell is formed which surrounds at least a part of the core as best seen in relation to FIGS. 1 and 2 of this patent. However a core is required for this structure unlike the present subject matter of the instant application.

U.S. Pat. No. 4,720,951 assigned to Therma-Tru Corporation, Toledo, Ohio, teaches an improved frame assembly for windows, doors and the like having a first and second skin, having internal support ribs wherein an insert is provided in between the skins as illustrated best in FIG. 3 which provides a solid surface for attaching hinges, drilling holes for door or window handles and lock assemblies and the like. The skin is manufactured from fiberglass reinforced polyester because of the thermal advantages of the qualities of fiberglass. The reinforcing portion extends throughout the frame between the skin portions as illustrated in the above figure. Again the instant invention does not contain such an internal portion.

Great Britain Patent Application 2,148,963 provides a pultruded glass reinforced web which acts as a thermal insulation within aluminum extrusions.

European Patent Application 0 022,436 to Gamp describes as best understood by the Applicant members of glass fibre reinforced plastic material having dovetail corner joints in a window assembly. Nowhere within this reference is taught the mounting of hardware as the substance of the application only relates to the dovetail corner joints.

West German Offenlegungsschrift 2,904,295 to Maunz describes a compound window made from plastics and having a wing of metal. The plastic window may be reinforced with fiberglass.

The following patents describe in detail among others the pultruding technique known in the prior art: U.S. Pat. No. 4,559,262 to Imperial Chemical Industries, U.S. Pat. No. 4,394,338 to Mitsubishi Petrochemical Company Limited, U.S. Pat. No. 4,540,737 to Celanese Corporation, U.S. Pat. No. 4,541,884 to Imperial Chemical Industries, Canadian Pat. No. 1,011,612 to Ube-Nitto Kasei Co., Ltd., of Japan, Canadian Pat. No. 945,713 to Glastrusions, Inc., of California, Canadian Pat. No. 920,310 to The English Electric Company Limited, Canadian Pat. No. 869,604 to Glastrusions, Inc.of California, U.S. Pat. No. 4,640,065 to Owens-Corning Fiberglass and U.S. Pat. No. 4,564,540 by Davies.

Referring now to U.S. Pat. No. 4,640,065 there is provided a core material of a shaped glass fiber board impregnated with resin in the outer surface portion which is cured.

The structure is best observed in relation to FIG. 3. A considerable amount of fiberglass therefore is used in order to prepare such framing sections, it being cost prohibitive and difficult to justify forming windows by such framing sections. Nowhere within the 4,640,065 Patent is there taught the manufacture of thin walled pultrusions preferably in the range of twenty five thousandths of an inch to two hundred and twenty five thousandths of an inch from which framing sections may be manufactured by known pultrusion techniques.

Referring now to U.S. Pat. No. 4,564,540, nowhere within this patent is there taught the use of thin walled pultrusions for anything more than a spacing member as clearly seen in relation to FIGS. 1 and 2.

The instant invention may be manufactured by any known pultrusion techniques and methods of those described in the prior art discussed above, the methods of which are herein incorporated by reference. In this respect, Applicant's structure may be formed by any of the above pultrusion techniques depending on the end product desired.

It is known within the prior art to reinforce hollow framing sections. Great Britain Pat. Specification 1,522,475 describes a window frame of plastic having a thickness of between 3 ½ to 6 mm of plastic. It is necessary to provide internal continuous reinforcing webs of plastic material to provide a frame of adequate strength. When considering the cost of plastic to the higher cost of wooden frames it is possible to reduce the thickness of the plastic while maintaining the strength by providing continuous metal strengthening portions of any suitable metal alloy or by concrete members. Thus the elongate plastic members are assembled to form a frame work and metal or reinforced concrete members are externally affixed to the framework, the metal or reinforcing concrete members serving to strengthen the hollow plastic members. This invention is best observed in relation to the figures illustrated at FIG. 2. However, the forming of a plastic window does not have the thermal properties known to be inherit in fiberglass. Thus, the thermal expansion of the plastic will be significantly different from the concrete or the window pane and it is impossible that the window may experience fogging problems in cold weather. Applicant's structure however being made from fiberglass having all of the known qualities of fiberglass will tend to have improved response to thermal expansion.

Another example of reinforcing portions found within the prior art are found in West German Pat. 2,818,696 to Frei, and West German 3,132,938 to Brickenstein. Another reference, European Pat. 156,108, shows the use of trapezoidal metal reinforcing profiles inserted within cavities. However, the reinforcing profiles are not used for mounting hardware thereto.

Within the prior art there also exists a number of publications and patents which teach reinforcing of frame portions. These teachings are exemplified by West German Offenlegungsschrift 2,545,209 to Bruder which describes a reinforcing angle piece for the corner of window or glass panes, West German Offenlegungsschrift 3,040,625 which describes a stiffened hollow plastic window frame by a corner member, West German Offenlegungsschrift 2,730,633 to Schock which teaches the angle portion to square the corners of a miter joint, West German Offenlegungsschrift 2,300,281 to Köpke which describes a corner reinforcement for a plastic profile door or window frames and U.S. Pat. No. 3,836,274 which describes a corner joint for a miter cut hollow profile member of plastic.

U.S. Pat. Nos. 4,662,110, 4,726,145 and 4,691,474 to Rokicki describe my sliding door assembly wherein are provided cam portions as best seen in FIGS. 5 and 6 of U.S. Pat. No. 4,726,145, the cam portions being connected together by a cable portion which is fastened together by a turn buckle type arrangement. By fastening the cable together by a turn buckle arrangement it has resulted in a very time consuming assembly process for the sliding door assembly. Further the joint so formed has proven to fail in time and slip resulting in the cams going out of coincident motion. This specification further teaches an improvement for joining cable systems and specifically for joining the cables together within the instant invention. The teachings of the above-mentioned patents to Rokicki are hereby incorporated by a reference in relation to the structure of the sliding door assembly.

Nowhere within the prior art is there taught a thin walled pultrusion manufactured from fiberglass which forms a framing section for a closure member, preferably the thin wall pultrusion having a thickness of between twenty five to two hundred and twenty five thousandths of an inch and having reinforcing portions disposed within the channels, flanges, or grooves formed with the pultrusion to allow for the mounting of hardware on the framing sections when formed into closure assemblies or to allow the mounting of the closure assembly within an opening.

One of the problems facing commercial success of forming closure assemblies of thin walled pultrusions is the fact that fiberglass is very brittle. Whenever a fastener is inserted in such a pultrusion the glass fibres will crack and shatter around the opening. The prior art indicates that closure assemblies can be formed from fiberglass only when there is a core member such as wood or fiberglass between outer shells of fiberglass.

Fiberglass of course is expensive. By forming thin walled pultrusions of the thickness described above, one would be able to improve the yield in forming framing sections by known pultrusion methods. Further by providing reinforcing portions contained in strategic locations with each pultrusion the formation of a closure assembly allows for the mounting of hardware on the thin walled pultrusion or the mounting of the assembly itself which would not be mountable unless the fiberglass pultrusion were reinforced around the point upon which the hardware will be mounted. For example, the ends of the pultrusion may be moulded with nylon reinforcing portions to ensure that the brittle properties normally associated with fiberglass are not prevalent when mounting the hardware or the frame members to each other. By providing such reinforcing portions such as plastic mouldings proximate the end of the framing section or wherever the hardware may be mounted, considerable savings is realized in forming the thin walled pultrusions which would flake and crack easily if it were not for the reinforcing portions. Reinforcing portions may also be metal portions or any portion convenient to reinforce a thin walled pultrusion of the instant invention. The prior art structures allow for continuous reinforcement throughout the entire length of the framing portions rendering them much less economical.

Supplementary portions for squaring miter framing sections and joining pultrusion sections are also provided with this disclosure which are not found in the prior art in combination with the teachings of the instant invention.

It is therefore a primary object of this invention to provide thin walled pultrusions preferably between twenty five and two hundred and twenty five thousandths of an inch in thickness which may be used to form framing members for closure assemblies, when the pultrusions are reinforced proximate their ends and at positions where hardware or the assembly will be mounted.

It is a further object of this invention to provide closure assemblies manufactured from thin walled pultrusion sections as described above having unique portions for bracing and squaring the corners.

It is another object of this invention to provide a closure assembly which is economical to manufacture and which has the recognized thermal properties of fiberglass and the strength thereof.

It is a further object of this invention to provide an improved joint for cable systems especially those found within sliding door assemblies having cam portions and separate pivots as found in the prior art described above.

Further and other objects of this invention will become apparent to a man skilled in the art when considering the following summary of the invention and the more detailed description of the preferred embodiments illustrated herein.

SUMMARY OF THE INVENTION

To these ends and according to a primary aspect of the invention there is provided a thin walled fiberglass pultrusion preferably of a thickness of substantially between twenty five and two hundred and twenty five thousandths of an inch, the pultrusion used for forming framing sections for closure assemblies and when assembled including reinforcing means with each pultrusion to allow for the joining of; the framing sections in the closure assembly, the hardware associated with the assembly to the assembly, and adjacent pultrusions to one another. In another embodiment the thickness of the wall of the pultrusion is substantially in the range of ten to two hundred and twenty five thousandths of an inch. Preferably the reinforcing means are discrete discontinuous reinforcing portions which are fastened to predetermined portions of each pultrusion such as channels, grooves, and/or flanges provided with the pultrusion when formed.

According to one aspect of the invention, there is provided a closure assembly comprising thin walled fiberglass pultrusions of sufficient thickness to require reinforcement when the pultrusions are joined to adjacent pultrusions, mounted within an opening for the closure assembly or when hardware is mounted to the pultrusions.

According to another aspect of the invention there is provided for use as a framing section for doors and windows or the like, a thin walled fiberglass pultrusion comprising two ends, each pultrusion having formed therewith at least one channel, groove, flange or the like, the pultrusion being of predetermined thickness, preferably the wall thickness of each pultrusion being substantially in the range of twenty five to two hundred and twenty five of an inch, in another embodiments the pultrusion has a thickness of substantially in the range of ten to two hundred and twenty five thousandths of an inch, each pultrusion in use having disposed proximate at least one end thereof first reinforcing means for interconnection of the pultrusion with like pultrusions in forming a framing section, in one embodiment the first reinforcing means including corner brackets, preferably made from nylon, having mounting means, preferably arms, preferably each bracket being an angle bracket, preferably being substantially L shaped, each arm of the bracket being affixed to proximate the end of each pultrusion when the frame is assembled, in another embodiment the first reinforcing means further comprises a reinforcing member having compatible flanges, channels or grooves which engage with the pultrusion and allow fastening thereof to adjacent pultrusions proximate the end of the pultrusion, preferably the first reinforcing means having detent portions therewith, preferably cylindrical channels for receiving threaded fasteners the pultrusion and/or adjacent pultrusions being connected thereto; preferably each pultrusion having disposed therewith at predetermined locations second reinforcing means for mounting hardware means, for example latches, locks, tracks, handles, pivots, or the like, or any hardware normally attached to conventional framing sections, the second reinforcing means preventing cracking of the pultrusion proximate the hardware means when the hardware means is mounted thereto, preferably the second reinforcing means being formed in predetermined shapes to compliment the shapes of the at least one channel groove or flange when the second reinforcing means are affixed therewith. In a preferred embodiment the second reinforcing means includes portions which engage the outer flanges of the framing section to stiffen the section and to further provide a flange to fasten the sections within an opening when assembled.

According to yet another aspect of the invention there is provided a closure assembly comprising a first peripheral frame defining an opening within which a moveable closure member is supported, preferably the closure member further comprising a second peripheral frame, each frame including first and second framing portions, preferably at least one of the first and second framing portions and preferably all portions of the first and/or second peripheral frame includes at least one framing portion being at least one thin wall fiberglass pultrusion having at least one groove, channel or flange formed therewith, the wall of the pultrusion being of a predetermined thickness preferably substantially between twenty five to two hundred and twenty five thousandths of an inch or alternatively substantially between ten to two hundred and twenty five thousandths of an inch, each fiberglass pultrusion being affixed to the adjacent pultrusion by first reinforcing means, the closure member having affixed thereto hardware means, the hardware means being mounted with pultrusions at predetermined locations by providing second reinforcing means to reinforce the fiberglass pultrusion proximate each predetermined location for mounting the hardware means. In a preferred embodiment the second reinforcing means includes portions which engage with flanges on the exterior of pultrusions to reinforce the flanges and further to provide a mounting flange for mounting the closure assembly in an opening.

According to yet another aspect of the invention the first and/or second framing portion may further comprise in use first reinforcing means being brackets made of nylon having compatibly shaped portions to engage with the at least one groove, channel or flange of the framing portions, thereby connecting adjacent framing portions. In another embodiment the first and/or second reinforcing means may be molded in predetermined positions with some of the pultrusions.

According to yet another aspect of the invention the framing portion may further comprise in use first reinforcing means being right angled brackets engaged with the at least one groove, channel or flange of the framing portion, thereby squaring the orientation of adjacent framing sections with respect to each other when assembled.

According to yet another aspect of the invention the framing portion may further comprise in use second reinforcing means having a base and at least one appendage extending upwardly away from the base preferably the appendage being flanges disposed with the base, to brace the second reinforcing means in the at least one channel, groove, or flange, thus rigidifying the channel, groove or flange, preferably the base having detent means disposed therewith preferably aligned with detent means disposed with the pultrusion for mounting hardware therefor. Preferably the detent means are openings. In another embodiment the base has a coplanar tang extending therefrom to abut the pultrusion in use.

In a preferred embodiment the pultrusion forming the sill portion of the closure assembly further comprises detent portions proximate the edges thereof to engage with detents disposed with supplementary portions, such as aluminum extrusions for track assemblies, to be assembled therewith in use, preferably the pultrusion and the extrusion also being connected to reinforcing portions which are affixed to both the pultrusion and the extrusion with the flanges, grooves, and/or channels formed therewith.

According to yet another aspect of the invention, the closure assembly may further comprise a substantial right angled three-dimensional bracket having two appendages, the appendages for joining adjacent pultrusions proximate the at least one groove, channel or flange thereof, preferably the bracket being manufactured from resilient materials such as fiberglass, plastic, nylon or the like and preferably for insertion within an opening or channel disposed proximate each end of adjacent pultrusions. In one embodiment the three-dimensional bracket is moulded from moldable materials having reinforcing portions therewith preferably truss like portions to provide the necessary strength for connected adjacent pultrusions.

In one embodiment the hardware means may comprise window opening mechanisms. In another embodiment the hardware means may comprise locking portions, or handle portions. In yet another embodiment the hardware means may comprise mounting brackets for mounting the closure assembly in an opening, preferably the mounting bracket having detent portions which engage and rigidify the pultrusions and a mounting or nailing flange disposed therewith for mounting the closure assembly in an opening.

In yet another embodiment the first reinforcing means may further comprise a first portion preferably formed from metal, having compatible shaped portions formed therewith to engage the at least one groove, channel or flange of pultrusions, preferably the first portion having disposed therewith first detent portions, preferably openings, to fasten the first portion to the pultrusion, the first portion having second detent portions therewith, preferably substantially C-shaped cylinders preferably for receiving threaded fasteners, to fasten adjacent pultrusions to the first portions and the pultrusion to which it is fastened. Preferably the fasteners used are threaded fasteners. Preferably notches disposed with either the first portion and or the pultrusion engage flanges with either the first portion or pultrusions when fastened.

According to yet another aspect of the invention there is provided a closure assembly comprising a peripheral frame defining an opening in which a moveable closure member is supported, the closure assembly having disposed proximate at least one end thereof cam portions upon which the closure member moves, each cam portion being affixed to other cam portions at the same end of the closure member by connecting means, preferably a length of cable, each cam portion having disposed therewith detent means to engage the connecting means and to be fastened therewith by fastening means engaging the detent means and the connecting means, preferably the connecting means is a cable having two ends formed in a figure eight passing through openings in each cam and being tightened and fastened thereat by a block insert through which the cable ends pass and are pulled tight when assembled, the block inserts are disposed within the opening of each cam and locked in position with the cable and block by a threaded fastener, whereby during assembly the connecting means is pulled tight with respect to the detent means of each cam prior to engaging the fastening means thus fastening the connecting means proximate the detent means of the cam ensuring substantially coincident motion of each cam with other cams disposed at the same end of the closure member.

According to yet another aspect of the invention the closure assembly may further comprise framing portions wherein at least one framing portion is a thin walled fibre glass pultrusion preferably having a thickness of substantially between twenty five to two hundred and twenty five thousandths of an inch. Alternatively the thickness may be substantially in the range of ten to two hundred and twenty five thousandths of an inch.

According to yet another aspect of the invention the reinforcing portions may further comprise abutting portions which abut the portions formed with the pultrusions in use thereby reduce the amount of free play in the assembly.

In yet another aspect of the invention there is provided a method of assembling a closure assembly comprising:

(i) Forming a closure member having two ends from framing portions, the closure member suspended or supported from a closure assembly, the framing portions of the closure member having at least two openings at both ends of the closure member and extending laterally from the closure assembly, (ii) Inserting a link member through each pair of openings of the closure member, (iii) Placing cam portions having first detent means therewith (preferably an opening) to engage the ends of each link member, and having second detent means, (iv) Providing interconnecting means (preferably a cable) extending between adjacent cam portions, for engagement with the second detent means of each cam, (v) Looping the interconnecting means around adjacent cam means in a loop preferably engaging the cam in a groove disposed about the perimeter of each cam, preferably a figure eight loop.

(vi) Passing the end of the interconnecting means proximate the second detent means of each cam to engage therewith and pulling tight.

(vii) Fastening the interconnecting means by fastening means to the second detent means of each cam portion whereby adjacent cams will move in unison as a result of the assembly.

According to yet another aspect of the invention the method may further comprise framing portions which are thin walled fiberglass pultrusions having a thickness of substantially between twenty five to two hundred and twenty five thousandths of an inch or alternatively substantially in the range between ten and two hundred and twenty five thousandths of an inch.

According to yet another aspect of the invention the method may further comprise the assembly of patio doors, preferably the patio door being slideable on truck portions disposed in channels at both ends of the closure members wherein the cam portions are connected, thereby allowing sliding and pivoting motion of the patio door assembly.

According to yet another aspect of the invention the method may comprise interconnecting means being a cable which loops around adjacent cam portions and is inserted with a block portion which is fastened with the cam portion by a thread fastener thus locking the block portion and cable in position allowing for presetting of the tension on the cable.

According to yet another aspect of the invention, there is provided a closure assembly comprising a closure member moveable with respect to the assembly and having two ends formed from framing portions, the closure member being suspended or supported from a closure assembly, the closure member having at least two openings at both ends extending laterally from the closure assembly and having a link member with each pair of openings of the closure member, having cam portions having first detent means therewith preferably an opening to engage the ends of each link member, and having second detent means disposed therewith, having interconnecting means preferably a cable extending between adjacent cam portions for engagement with the second detent means of each cam, having interconnecting means looping around adjacent cam means in a loop, preferably engaging the cam in a groove disposed about the perimeter of each cam, preferably in a figure eight loop; whereby in use the end of the interconnecting means proximate the second detent means of each cam is engaged therewith and pulled tight and whereby fastening means disposed with each cam portion fastens the interconnecting means of the second detent means of each cam thereby allowing adjacent cams to move in unison.

According to yet another aspect of the invention, the closure assembly may comprise interconnecting means being a cable which loops around adjacent cam portions and is inserted within a block portion which is fastened with the cam portion by a threaded fastener thus locking the block portion and cable in position allowing for presetting of the tension on the cable.

According to yet another aspect of the invention, the closure assembly may further comprise framing portions which are thin walled fiberglass pultrusions having a thickness of substantially between twenty five to two hundred and twenty five thousandths of an inch or alternatively substantially in the range of ten to two hundred and twenty five thousandths of an inch.

According to yet another aspect of the invention, the closure assembly may further comprise an assembly of patio doors, preferably the patio door being slideable on truck portions disposed in channels at both ends of the closure members, wherein the cam portions are connected thereby allowing sliding and pivoting motion of the patio door assembly.

BRIEF DESCRIPTION OF THE DRAWINGS

The following figures illustrate preferred and alternative embodiments of the invention, wherein:

FIG. 2A is a top view of the joint of FIG. 2, illustrating the interconnection of the framing portions in a preferred embodiment of the invention.

FIG. 16A and FIG. 16B are supplementary views illustrating the components of FIG. 16 in a method of assembling those components illustrated in a preferred embodiment of the invention.

FIG. 29A is a perspective view of the bracket used in FIG. 29.

DETAILED DESCRIPTION OF PREFERRED EMBODIMENTS OF THE INVENTION

Referring now to FIGS. 1 through 21 inclusive, there is illustrated a patio door assembly incorporating components and assemblies of the instant invention. FIGS. 22 through 36 illustrate many components of the instant invention assembled as a pivotable window assembly. It is not intended that the instant invention be considered only as applicable to patio door assemblies and window assemblies. The instant invention finds practical application in door assemblies and other assemblies requiring a framing of a closure member such as a window, door, sky light, or the like. The components of both the patio door assembly and the window assembly are illustrated in preferred and alternative embodiments of the invention. It is not the intention of Applicant to limit the interpretation of the breadth of the invention by only the merits of the preferred and alternative embodiments illustrated and described herein.

Figure 1:
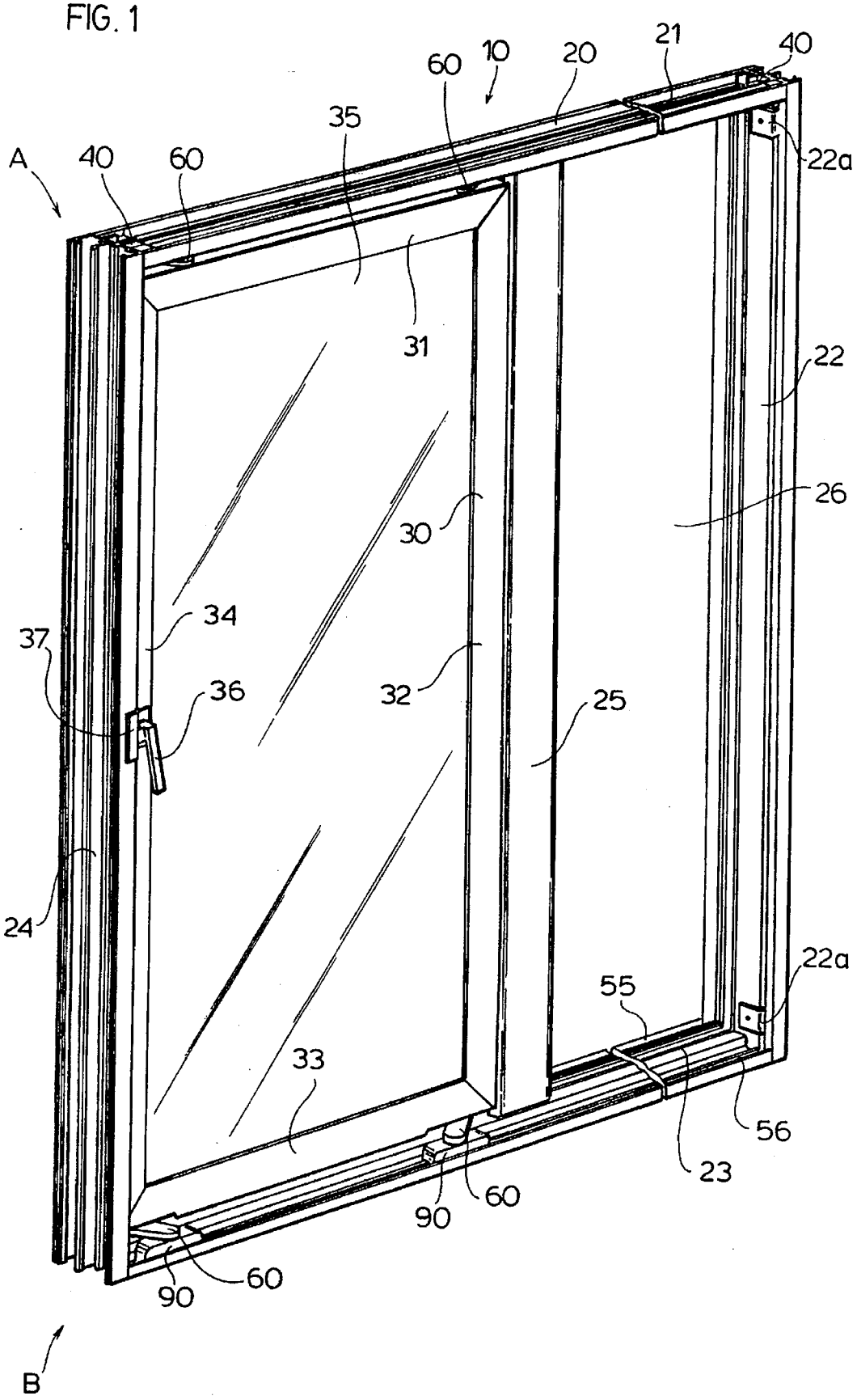
FIG. 1 is a perspective view of a patio door embodying components therefor illustrated in preferred and alternative embodiments of the invention.

Referring now to FIG. 1 there is provided a patio door assembly 10 having a top and bottom and two ends. The patio door assembly is made up of a fixed framing assembly 20 and a moveable closure member 30. The fixed framing assembly 20 includes a top member 21, a bottom member 23, a end member 22 and another end member 24. The end members 22 and 24 having disposed therebetween an intermediate portion 25 the use for which will be described hereinafter. The moveable closure assembly 30 includes a window pane not shown and framing portions 31 at the top thereof, 33 at the bottom thereof, 32 at one end thereof and 34 at the other end thereof. The closure assembly 30 is moveable on truck portions 90 which are attached to cam portions 60, the use of which is found in the previous Rokicki patents described in the background of the invention. The truck portions 90 are moveable on a track assembly which will be described hereinafter. Cam portions 60 are disposed proximate the four corners of the closure member 30. A window, 35 is disposed within the moveable frame including members 31, 32, 33 and 34 and 26 within the fixed frame including a portion of top framing portion 21 and bottom portion 23 and the intermediate portion 25 and the side portion 22. A stop portion 22*a* is provided to provide a resilient bumper for the closure assembly 30 when moved from its current position illustrated in FIG. 1 to the position wherein the framing portion 32 is located proximate the framing portion 22.

The framing portions 21, 22, 23 and 24 are hollow profiles manufactured by known processes and methods from fiberglass. In the art the manufacture of such framing sections is known as pultrusion. The framing sections 21, 22, 23, 24, 31, 32, 33, 34 and 25 are pultruded by methods such as those described in the prior art. The thickness of the wall of the pultrusions may vary from twenty five thousandths of an inch to two hundred and twenty five thousandths of an inch depending on the application of the instant invention. Applicant has formed pultrusions as thin as twenty five thousandths of an inch but it is believed that a thickness is pultrudable to ten thousandths of an inch. Since it is believed that such a thickness would not be suitable for window or door frames I have not recommended this thickness. Currently I am forming pultrusions at ninety thousandths of an inch for the finished product.

As is known in the art, pultrusion of fiberglass into thin forms results in a brittle member which does not readily accept screws and fasteners such as threaded fasteners. In order to assemble the patio door assembly made up of hollow pultruded framing sections of thickness of preferably ninety thousandths of an inch it is necessary to provide corner brackets 40 which act as joining portions and reinforcing portions at the ends of the pultruded framing members. A more detailed description of the brackets and their use will follow.

Pultrusion 23 is an exception in that pultrusion 23 has affixed thereto two aluminum track sections for the door assembly to allow for the motion of a truck portion 90 in the aluminum tracks joined to the pultrusion 23. Therefore an aluminum section 55 and 56 are connected to the pultrusion 23 using a bracket reinforcing portion similar in use to that of the structure of bracket 40 used to interconnect the portions 23, 55 and 56 together, the portions 23, 55 and 56 further interconnecting by detent portions provided on portions 55, 23 and 56 separate from the bracket 40 as will be described hereinafter. A wooden member may be inserted within the pultrusion 23 to provide the extra rigidity required when using the door frame as load bearing members.

The strength of fiberglass is well known in the art. However the use of hollow sections, such as those found within the patio door assembly of FIG. 1 is the substance of Applicant's invention in part.

Figure 2:
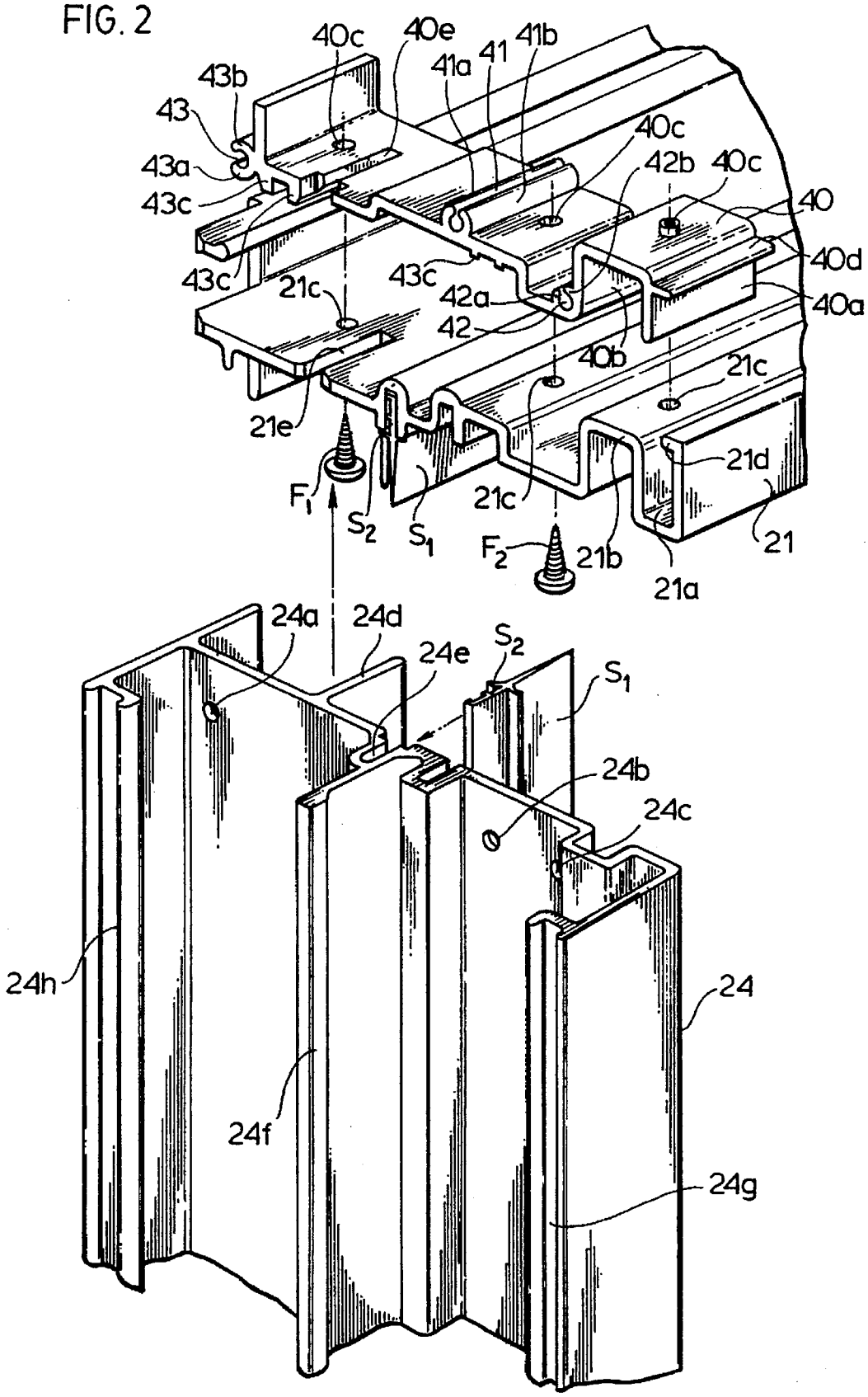
FIG. 2 is a close-up perspective view of the corner A of FIG. 1, illustrating the interconnection of the framing portions of the patio door assembly in a preferred embodiment of the invention.

Referring now to FIG. 2, there is illustrated the interconnection of the pultrusion 21 and the pultrusion 24 at corner A of FIG. 1. A reinforcing portion 40 is located at the end of the pultrusion 21, wherein the reinforcing portion is fastened by fasteners F1 and F2 in predetermined locations by passing the fasteners F1 and F2 through openings 21*c* and 40*c* of the pultrusion 21 and the reinforcing portion 40 respectively. In doing so many portions of the reinforcing portion 40 will marry with channels, grooves and ridges disposed on the cross-sectional portion of pultrusion 21. For example, as best seen in relation to FIG. 4, flange 40*d* and 40*a* will be contained within opening 21*a* of pultrusion 21 wherein the flange 40*d* will abut the flange 21*d* of pultrusion 21. Portion 21*b* which represents the top of a substantially inverted U-shaped channel of pultrusion 21 will be disposed within opening 40*b* of the reinforcing portion 40. Portions 43*c* disposed proximate the end of the reinforcing portion remote the flange 40*a* will abut the surface of pultrusion 21 extending generally around hole 21*c*. An opening or a slot 21*e* is provided in the pultrusion 21 proximate its end which cooperates with a slot 40*e* of the reinforcing section which when once assembled will contain the flange 24*d* of the pultrusion 24, thus interconnecting and aligning the pultrusions 21 and 24 in use. The reinforcing portion 40 has disposed therewith openings 41, 42 and 43 which are generally cylindrical in shape and are surrounded by arcuate flanges 41*a* and 41*b*, 42*a* and 42*b*, and 43*a* and 43*b*. These arcuate flanges provide the opening within which a threaded fastener illustrated best in relation to FIG. 4 may be inserted to further fasten the pultrusion 24 to the pultrusion 21 proximate the end thereof. The openings 24*a*, 24*b* and 24*c* disposed at the end of the pultrusion 24 are provided through which the fasteners not shown extend to join the pultrusions together. As can be readily seen from FIG. 2 the pultrusions are hollow with the exception of the reinforcing portion at the ends thereof and are provided with compatible flanges 24*h*, 24*f*, 24*g* which abut compatible flanges not shown of pultrusion 21. Seals S2 are provided in openings 24*e* and 21*ee* which provide a circumferential seal around the door assembly.

The need to provide the patio door assembly with reinforcing portions stems from the fact that thin fiberglass pultrusions do not readily accept threaded fasteners and would tend to rip, tear, shred and crack around the hole. It has been found that hollow profiles are not connectable. The instant invention provides reinforcing portions which allow the connection of hollow profiles proximate their ends without the result of cracking, tearing etc., and without the need to fill the hollow profiles with a continuous reinforcing internal member such as a wooden insert.

FIG. 2A illustrates the assembly of FIG. 2 from the top of pultrusion 24, wherein a flange 24*d* extends into the slots 40*e* and 21*e*, thus interconnecting the reinforcing portion 40, the pultrusion 21 and the pultrusion 24. Fasteners F engage the openings 41, 42 and 43 of the reinforcing portion 40 to fasten the pultrusion 24 to the reinforcing portion. The reinforcing portion is further fastened via threaded fasteners at openings 40*c* to interconnect the reinforcing member 40 with the pultrusion 21. Thus a joint is provided at corner A of patio door assembly 10 illustrated in FIG. 1 which aligns the pultrusions with respect to each other.

Figure 4:
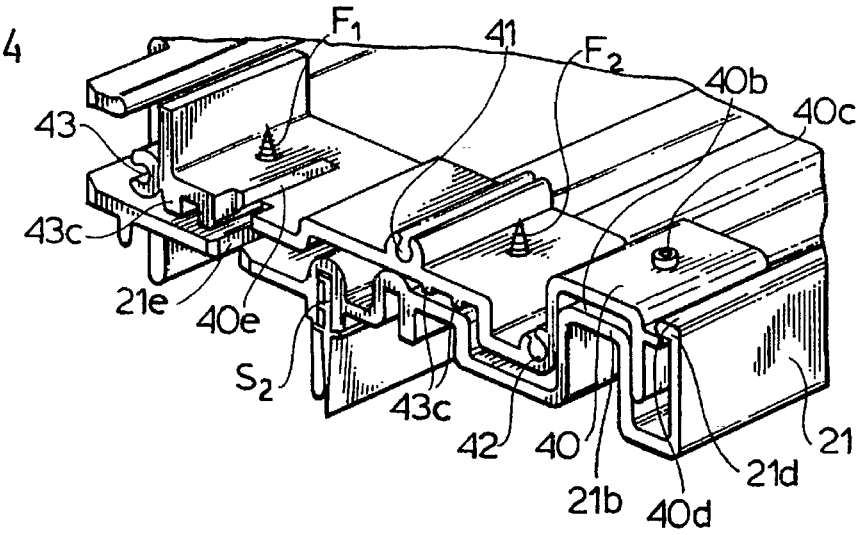
FIG. 4 is a close up perspective view of corner A, illustrated in a preferred embodiment of the invention.

Referring now to FIG. 4, there is illustrated the components of FIG. 2 when assembled showing the abutment of portions 43*c* with pultrusion 21 and the location of the cylindrical openings 41, 42 and 43 in relation to the openings 40*c* of the reinforcing portion. The openings 41, 42 and 43 are set out a predetermined distance to coordinate with the openings 24a, 24*b* and 24*c* disposed near the end of pultrusion 24. Thus, the positioning of the cylindrical portions providing openings 20, 41, 42 and 43 it is most important when forming the reinforcing portion 40. All of the components as described in relation to FIG. 2 are interconnected in similar fashion in FIG. 4.

Figure 3:
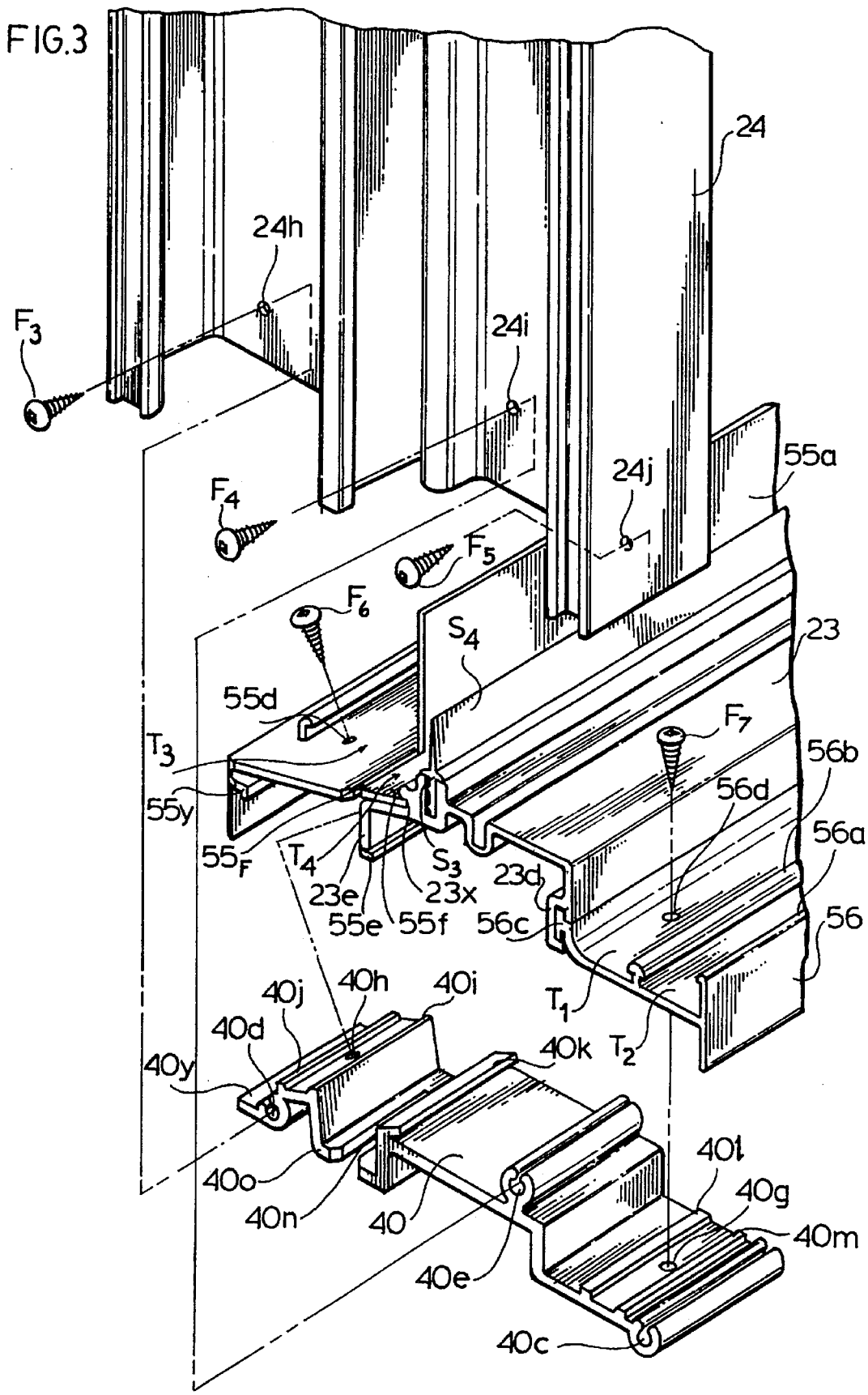
FIG. 3 is a view similar to that of FIG. 2, illustrating the joint between framing portions at union B, illustrated in a preferred embodiment of the invention.
Figure 5:
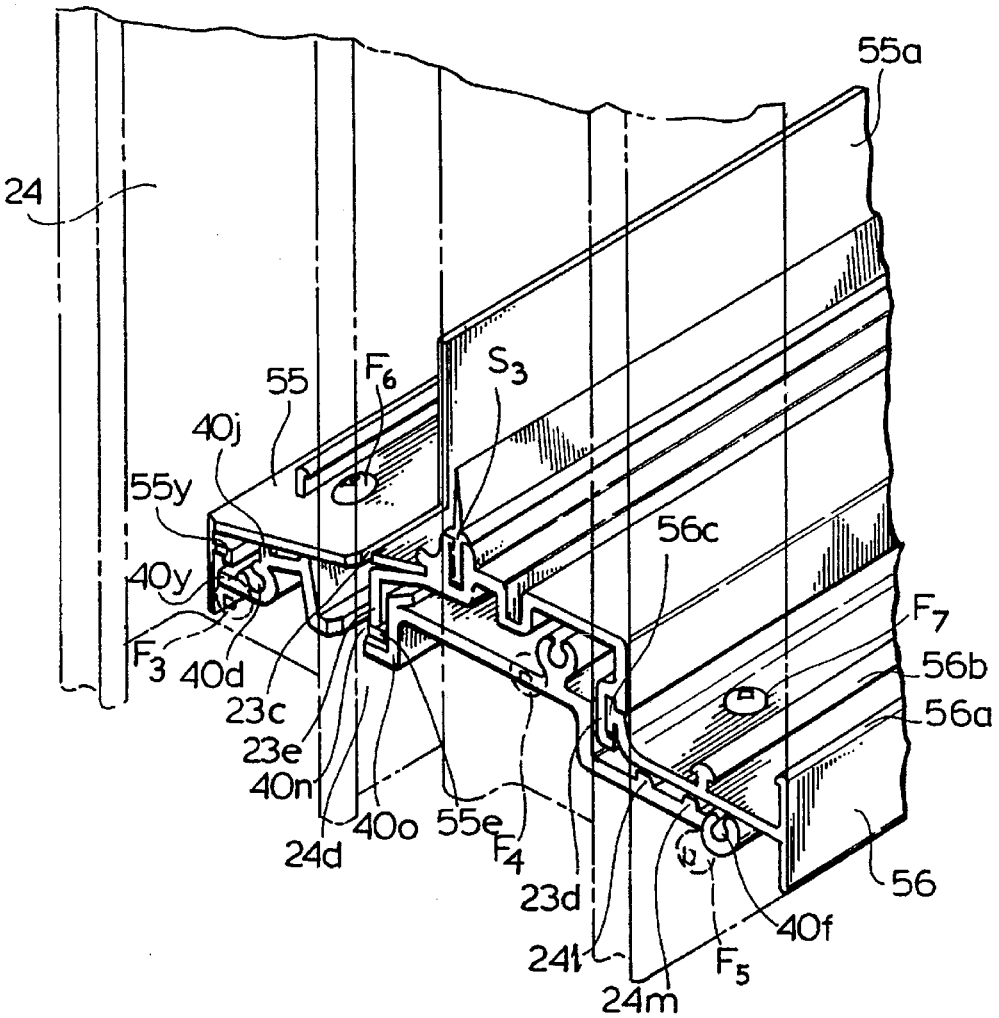
FIG. 5 is an assembled perspective view of the corner B illustrated in a preferred embodiment of the invention.

Referring now to FIG. 1, FIG. 3, and FIG. 5, there is illustrated the interconnection of pultrusion 24 near corner B of the patio door assembly of FIG. 1. The components in FIG. 3 are illustrated in exploded perspective to better describe their relationships. A pultrusion 23 is provided with a socket portion 23*d* near the front thereof which engages a generally T-shaped in cross-section portion 56*c* of an aluminum extrusion 56. The recessed 23*d* or groove thus captures the general T-shaped portion 56*c* thereby interconnecting the aluminum extrusion 56 with the pultrusion 23. The aluminum extrusion 56 has a front portion 56*a* behaving as a retaining portion, a rib 56*b* upon which the portion 90 of patio door assembly 10 of FIG. 1 rides. Disposed proximate the other side of aluminum extrusion 56 is a second aluminum extrusion 55 which is attached to the other side of the pultrusion 23 by another groove 23*x* disposed within the pultrusion wherein a flange portion 55*f* extends therein to interconnect the extrusion with the pultrusion. Further a lip portion 55*e* engages a flange portion 23*e* to further interconnect the extrusion 55 with the pultrusion 23. Once the pultrusions 55 and 56 are engaged with the pultrusion 23 the reinforcing insert 40 is inserted to align the slot 40*n* of reinforcing portion 40 with the slot 55*f* of the pultrusion. Openings 40*h*, 40*g* extending through the reinforcing portion 40 will engage fasteners F7 and F6 which extend through the openings 55*d* and 56*d* in the aluminum extrusions 55 and 56 respectively to interconnect the extrusion of the reinforcing portion. An opening not shown may also be included to engage the pultrusion 23, but in use this has not found to have been necessary. A weather seal not shown is disposed on the other side of the upwardly extending web 55*a* to engage and ensure the sealing of the window portion therein. Abutting portions 40*i* and 40*j* abut the angled sloping portion proximate the hole 55*d* of the aluminum extrusion 55. The abutments abut underneath such portion of the extrusion. A flange 55*y* extends above the flange 40*y* of the reinforcing portion 40. Openings 40*d*, 40*e* and 40*f* are disposed in cylindrical portions with the reinforcing members similar to that found in relation to FIG. 2. These portions will engage threaded fasteners F3, F4 and F5 which extend through the openings 24*h*, 24*i* and 24*j* of pultrusion 24 which will then fasten the pultrusion 24 to the reinforcing portion 40 which is attached to the pultrusion 23 and the supplementary aluminum extrusions 55 and 56. Abutting portions 401 and 40*m* will abut the underneath portion of the extrusion 56 on the other side of the rib 56*b*. A tapered wall adjacent the opening 40*h* and near the abutment 40*i* extending between the abutments 40*j* and 40*i* is compatibly engaged with the sloping surface of the underside of the aluminum extrusion 55 proximate the opening 55*d*. A seal S4 is provided which extends about the perimeter of the entire system.

Thus, in reviewing the joints of FIG. 5 and of FIG. 2 and 2A, it can be readily seen that pultrusions are connected to other pultrusions as well as to other extrusions by means of a reinforcing portion. The pultrusions are hollow and are only joined by the reinforcing portion proximate the end thereof to compensate for the brittle nature of fiberglass pultrusions. In alternative embodiments of the invention it is not necessary that the reinforcing portions such as portion 40 be made from metal, however it is preferred. For example, the reinforcing portion may be made from other materials such as space age plastic which will provide strength at the corners for the joints of the pultrusion framing sections.

Figure 6:
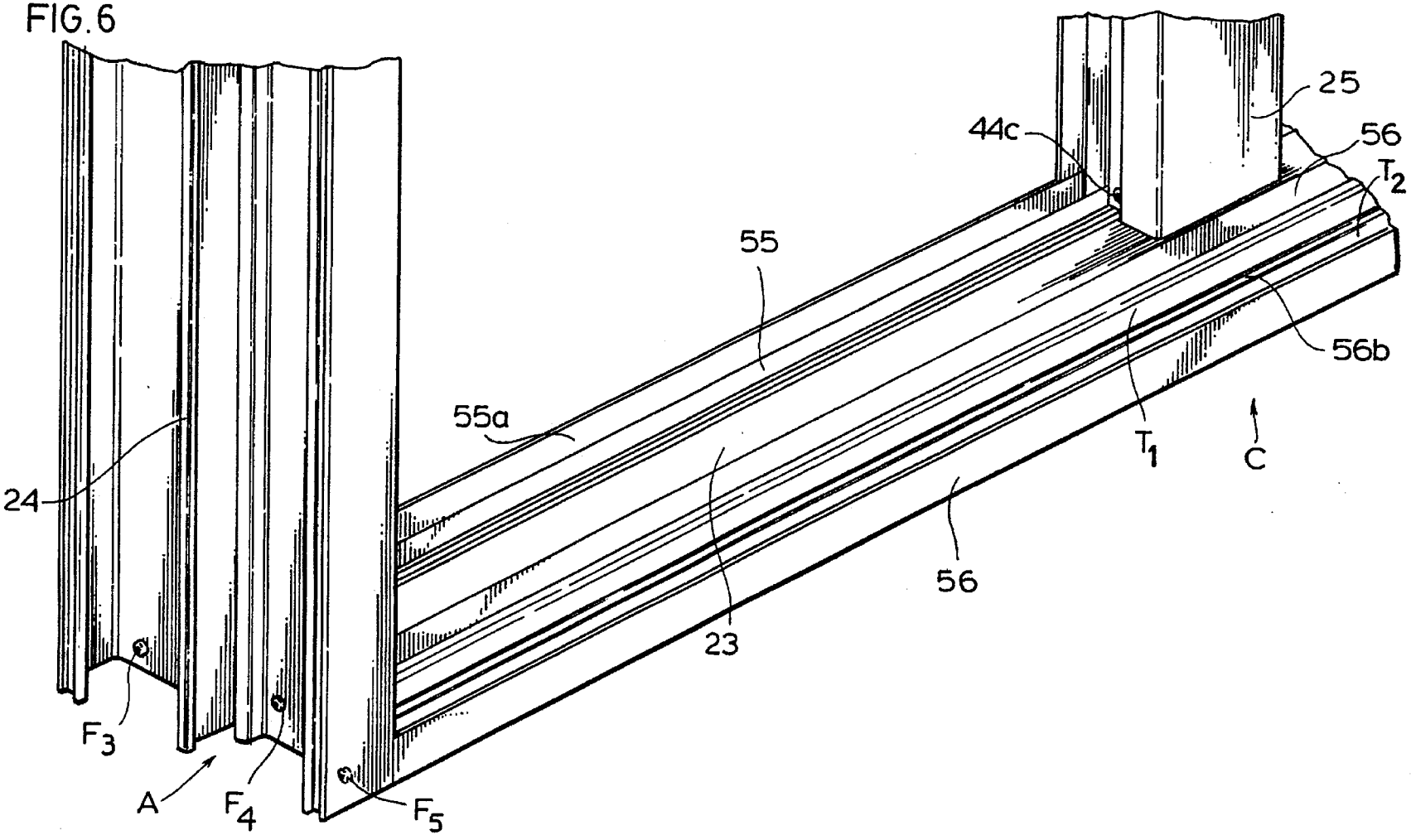
FIG. 6 is a close-up view of corner A and the components of the guide rails of the bottom portion of the patio door assembly illustrated in a preferred embodiment of the invention.

Referring now to FIG. 6, there is illustrated the structure of FIG. 5 and FIG. 3, illustrated and connected at corner B of FIG. 1. The aluminum extrusion 56 and 55 are connected as per the details of FIGS. 3 and 5 to form the footer portion of the assembly. The footer portion includes the pultrusion 23 along with the extrusions 55 and 56. A rib 56*b* is disposed therewith between track T1 and Track T2. An upwardly extending flange 55*a* extends from the aluminum extrusion 55 which acts as a weather guard for the framing section. The pultrusion 24 is thus connected thereto to via fasteners F3, F4, F5 as per the description in relation to FIG. 3 and FIG. 5. An upwardly extending portion 25 constitutes another framing section of the patio door assembly as shown in FIG. 1. The upwardly extending portion 25 must engage the top portion of pultrusion 23 as well as the upwardly extending flange portion 55*a* of the aluminum extrusion 55. Further, a reinforcing insert is provided within the pultrusion 25 to fasten the pultrusion 23 as best seen in relation to FIG. 7 and FIG. 8.

Figure 7:
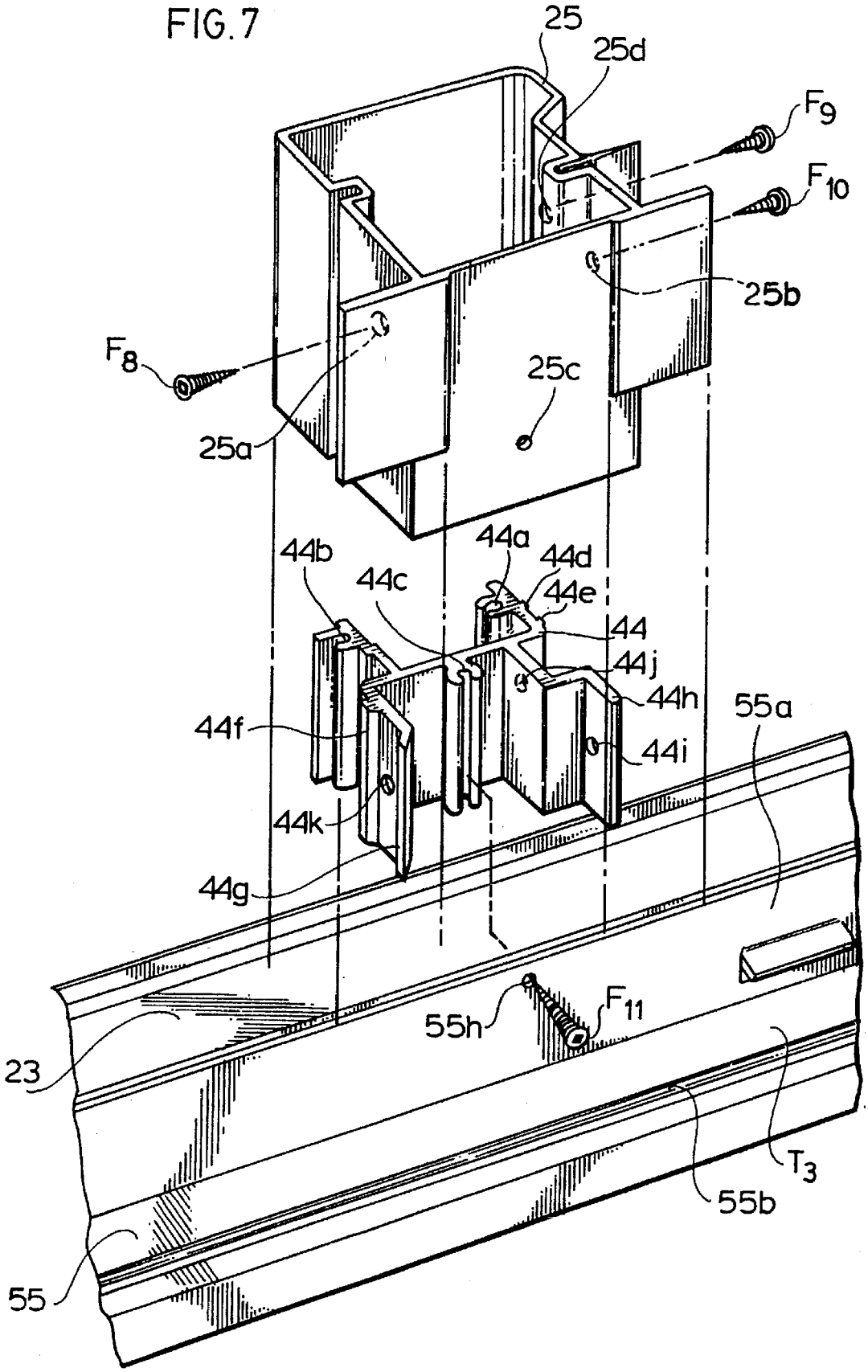
FIG. 7 is a exploded perspective view of joint C, illustrated in a preferred embodiment of the invention.
Figure 8:
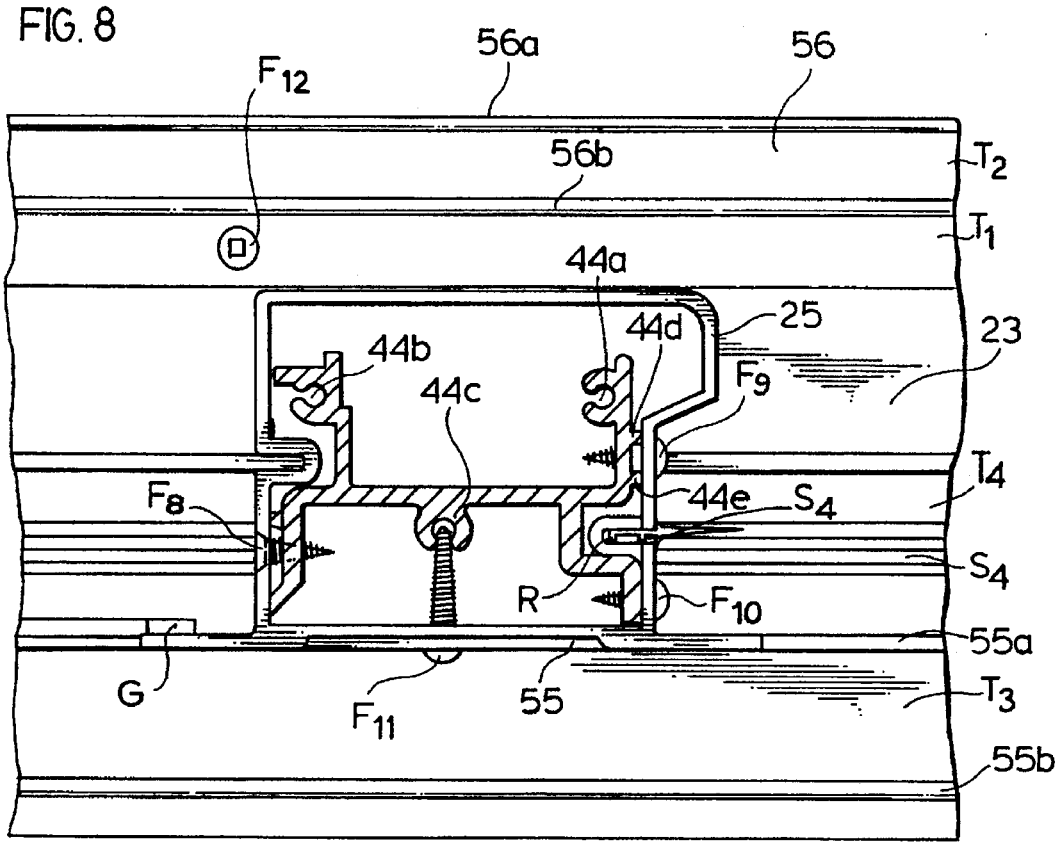
FIG. 8 is a top view of FIG. 7.

Referring now to FIGS. 7 and 8, a pultrusion 25 is illustrated in portion having outwardly extending flanges which extend laterally away from the end of the pultrusion 25 but stops just short of the bottom of the pultrusion before opening 25*c*. An opening 25*a*, 25*b*, 25*c* and 25*d* are disposed on the sides of the pultrusion to engage the pultrusion with the upwardly extending web 55*a* of extrusion 55 and the openings 44*i*, 44*j* and 44*k* disposed within the reinforcing portion 44. The reinforcing portion is shaped to fit within the opening of the hollow of pultrusion 25. Thus, a fastener F8, for example will engage with the opening 25*a* and the opening 44*k* disposed within the reinforcing portion 44. The cylindrical portions 44*a*, 44*b* and 44*c* are used for the same purposes as for the other reinforcing members previously illustrated and described. At the bottom of pultrusion 23, there is provided openings, not shown, which engage the bottom of the cylindrical portions 44*a*, 44*b* and 44*c* respectively. This fastens the reinforcing portion 44 to the pultrusion 23. The fastener F11 extends through the opening 55*h* of 55*a* into the bottom of 44*c* to fasten the aluminum extrusion 55 to the reinforcing portion. Abutment portions 44*f* and 44*g*, 44*e* and 44*d* are disposed within the profile of the reinforcing portion 44, which can be clearly seen in relation to FIG. 8 and abut the walls proximate fasteners F9, F8 etc. to provide additional reinforcing proximate the fasteners. A seal portion S4 is disposed within a groove portion proximate the side of the pultrusion 25 adjacent opening 25*b*. According to the requirements of the structure the pultrusion 25 is not affixed to the aluminum extrusion 55 in the preferred embodiment. Alternatively, it may be done in a compatible fashion to that wherein the member 56 is affixed to 25. Of course, it is known that at the top of pultrusion 25 a similar reinforcing portion 44 is disposed used in similar manner to that described in relation to the subject matter of FIG. 7 and 8.

Preferably the reinforcing portions such as 40 and 44 are made from extrude of aluminum. It is not necessary that they be made from aluminum and they may be alternatively manufactured from any other strengthening substance which provides the same features as described above.

Figure 9:
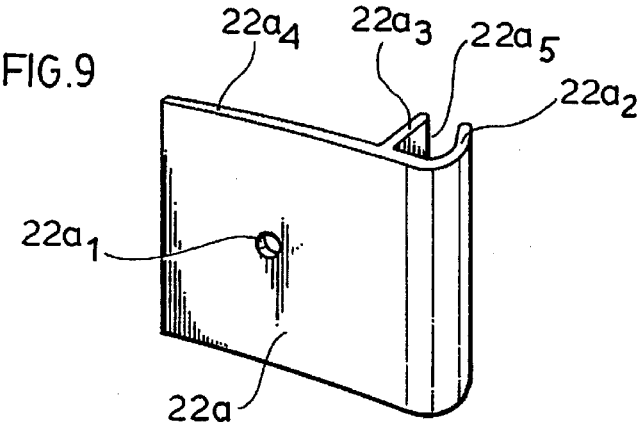
FIG. 9 is a perspective view of a stop device incorporated in the patio door assembly of FIG. 1.
Figure 10:
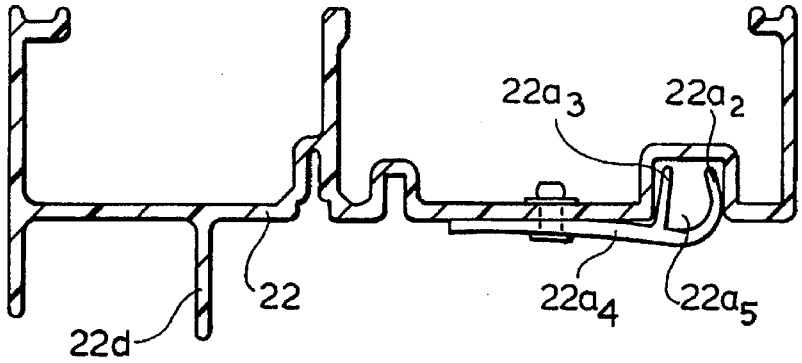
FIG. 10 is a top view of the framing section 22 of FIG. 1 illustrating the positioning of the stop mechanism of FIG. 9 illustrated in the preferred embodiment of the invention.

Referring now to FIG. 9 and FIG. 10, there is described and illustrated the stop portion 22*a* illustrated in FIG. 1. The stop portion is made from a resilient member, preferably plastic or synthetic rubber. The stop portion 22*a* has an opening 22*a*1 therethrough extending from a generally planar portion 22a4. Laterally extending flanges 22a2 and 22a3 provide a generally U-shaped containment for an opening 22a5. The opening and portions 22a3 and 22a2 are compressible within the generally U-shaped channel of pultrusion 22. A fastener fastens through the opening 22a1 to fasten the stop to the pultrusion 22. This stop acts as a bumper or cushion when the moveable door assembly 30 abuts the stop portions 22a.

Figure 11:
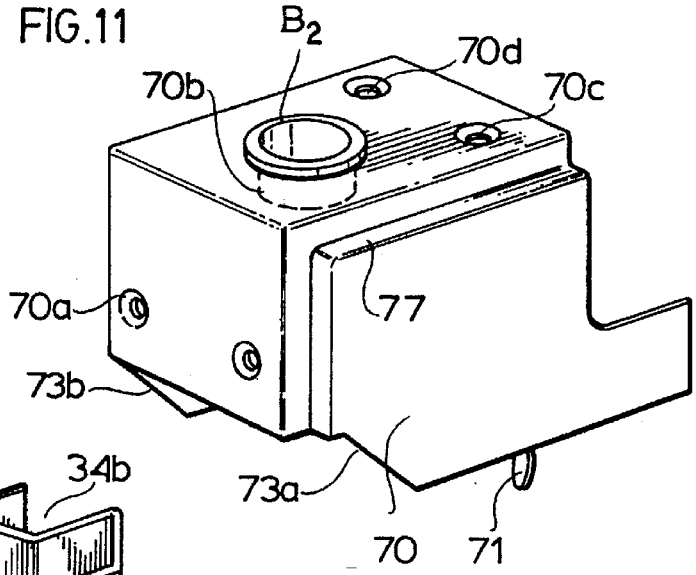
FIG. 11 is a perspective view of a corner bracket for joining framing portions of the moveable closure member 30 of the patio door assembly illustrated in a preferred embodiment of the invention.
Figure 12:
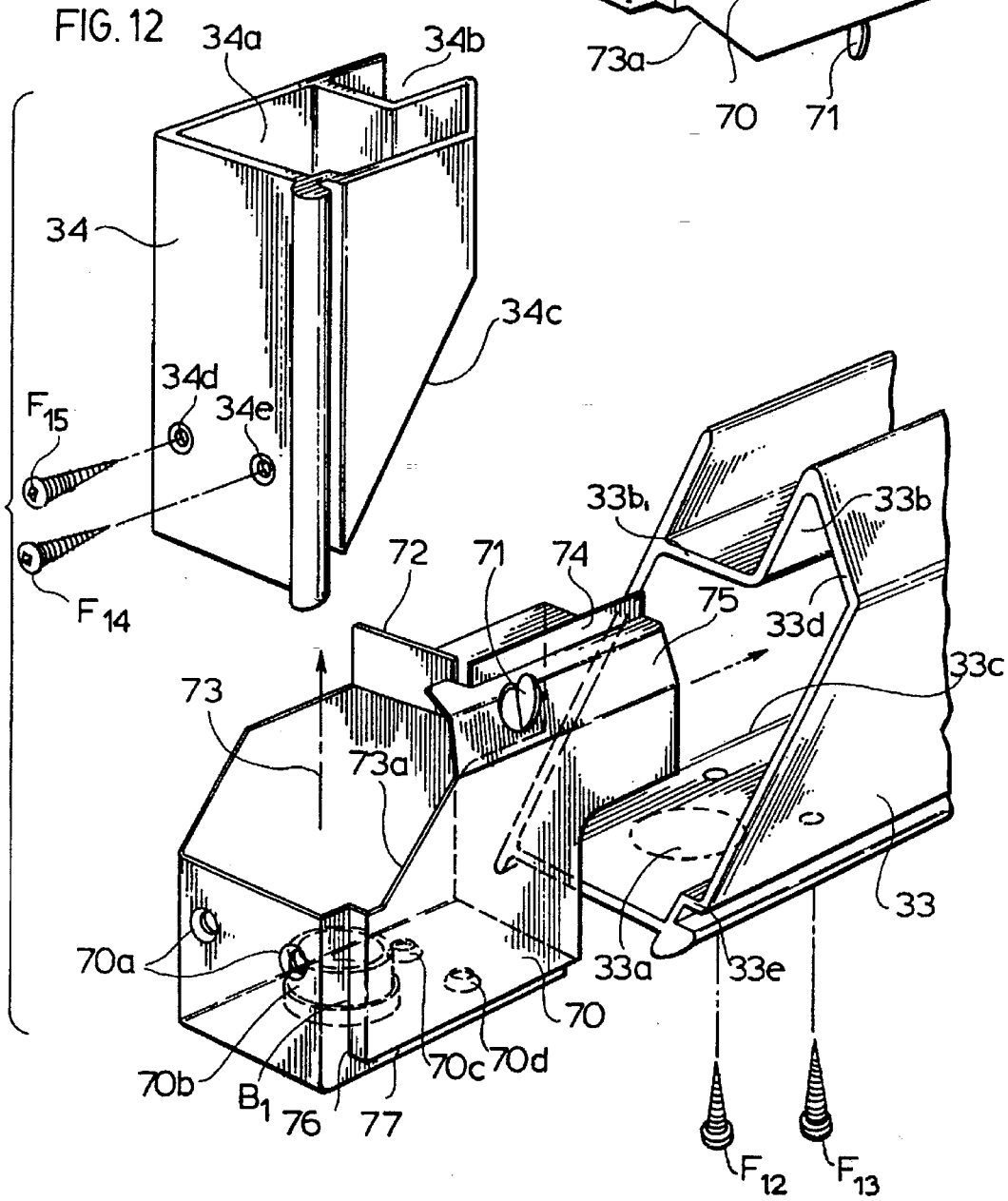
FIG. 12 is an exploded perspective view of the framing sections making up the moveable closure assembly 30 of FIG. 1 incorporating the bracket of FIG. 11 and illustrating the interconnection thereof in a preferred embodiment of the invention.

Referring now to FIGS. 11 and 12, there is described a corner bracket and the assembly thereof in relation to components 34 and 33 of the moveable closure assembly 30. The pultrusions 33 and 34 are hollow fiberglass pultrusions of the same dimensions described above in relation to the framing sections. The thickness is therefore between ten and one hundred thousandths of an inch. The interconnection bracket 70 is used to interconnect the pultrusions 34 and 33 at the corner proximate B of FIG. 1. The reinforcing portion 70 is a hollow member preferably made from galvanized metal by conventional methods. Openings 70c, 70d, 70a are set upon the top and sides of member 70. A bushing B2 extends through an opening 70b extending from the top or bottom of the enforcing portion depending on the orientation thereof. Angled corners 73b and 73a are disposed within the galvanized reinforcing bracket. A stop plate extending upwardly away from the portion 70 at 72 and is provided to abut forward edge of the pultrusion 33. A second stop 71 is provided to abut the mitered edge of the pultrusion 34c, thus orienting the pultrusions in relation to one another. An upwardly extending flange 74 abuts the material wall 33b of the pultrusion 33 to align the pultrusion 33 in relation to pultrusion 34. Forwardly extending appendage such as hollow 75 extends inwardly into the opening of pultrusion 33. An arcuate ramp 33e is disposed with the pultrusion to allow for the edge 77 which is stepped up from the bottom edge of the insert 70. To assemble and interconnect the pultrusions 34 and 33, the arm 75 extends into the pultrusion opening of 33 until the stop 72 abuts the forward edge 33b1 of pultrusion 33 with the ramp or step 77 extending on the arcuate portion 33e. The opening 70b for the bushing B2 will align with the opening 33a of the pultrusion 33. Insert 70 is hollow in order to provide an assembly which allows for the passage of link members best seen in relation to FIG. 20 therethrough. To complete the assembly the pultrusion 34 is then extending downwardly upon the portion 70 until the holes 34d and 34g align with the holes 70a and the stop 71 and 72 interconnects with the mitered edges comparable to 33b1 and 33d of pultrusion 34. This portion is not shown, however it will engage the portion of the member 70 including the stops 71, 72 and the upwardly extending portion wherein the hole 70a is disposed. Fasteners F12 and F13, F15 and F14 will then be interconnected through the openings 70d, 70c, 70a respectively of the reinforcing portion which joins the two pultrusions together.

Figure 29:
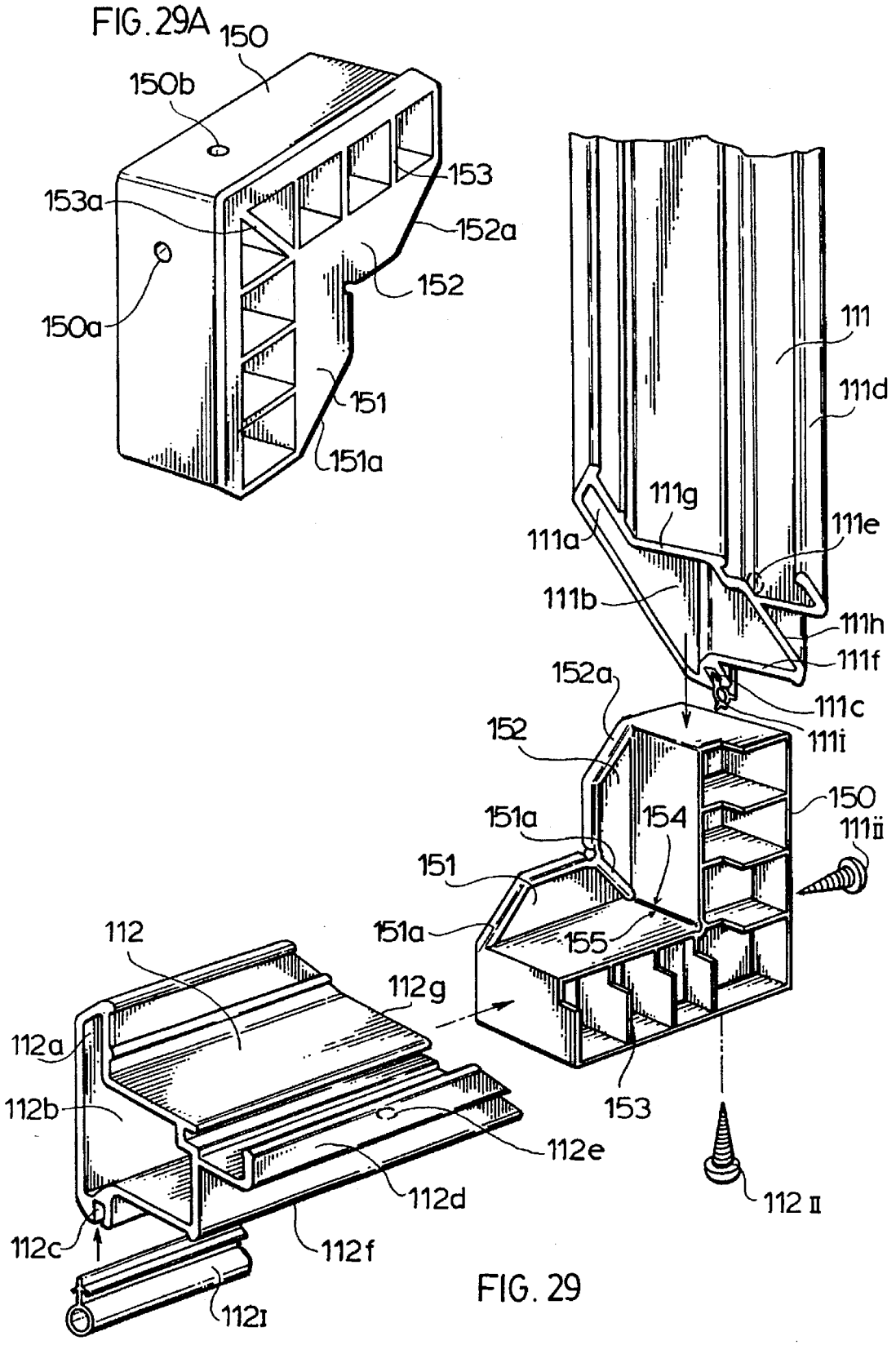
FIG. 29 is an exploded perspective view of the framing portions which make up the moveable closure member of the window assembly illustrated in FIG. 22 illustrating a bracket used for reinforcing and joining the end portions of the framing sections of the closure assembly illustrated in a preferred embodiment of the invention.

In relation to joining framing pultrusions together proximate their ends, it is not necessary that the portion 70 be made from metal, in fact, in an alternative embodiment illustrated in relation to FIG. 29, it is shown made from plastic. However, in using the structure with patio doors it is beneficial if the structure is hollow at least in part to allow the passage of a link member through the bushing to interconnect with the cams illustrated in relation to FIG. 20. In another embodiment bracket 70 may be molded from any suitable moldable material.

Figure 13:
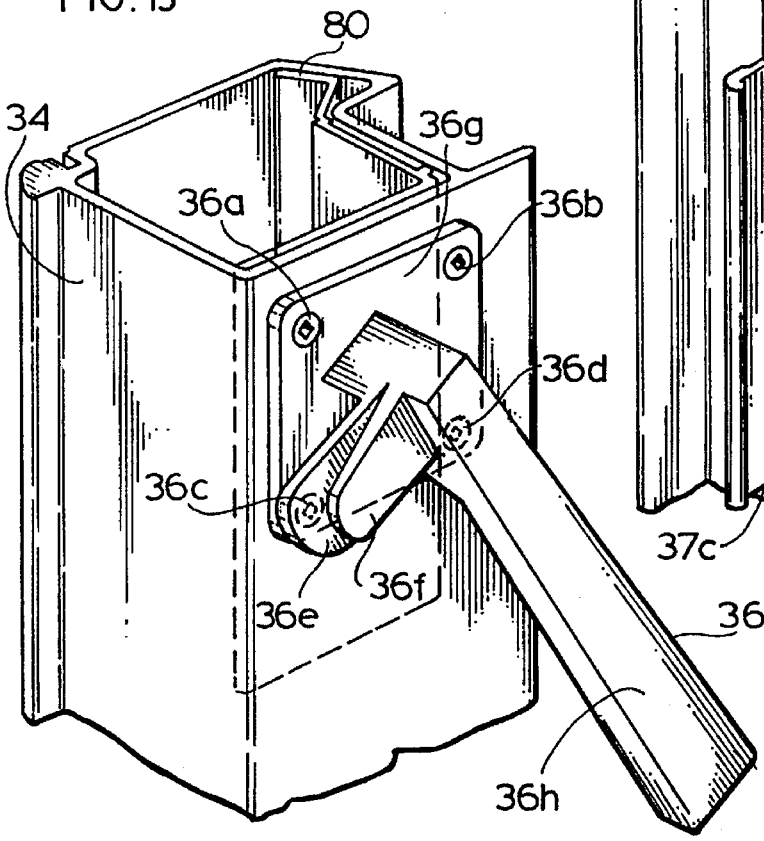
FIG. 13 is a cut away perspective view of the handle assembly 36 of the patio door illustrated in FIG. 1 showing the reinforcement of the handle assembly illustrated in a preferred embodiment of the invention.
Figure 14:
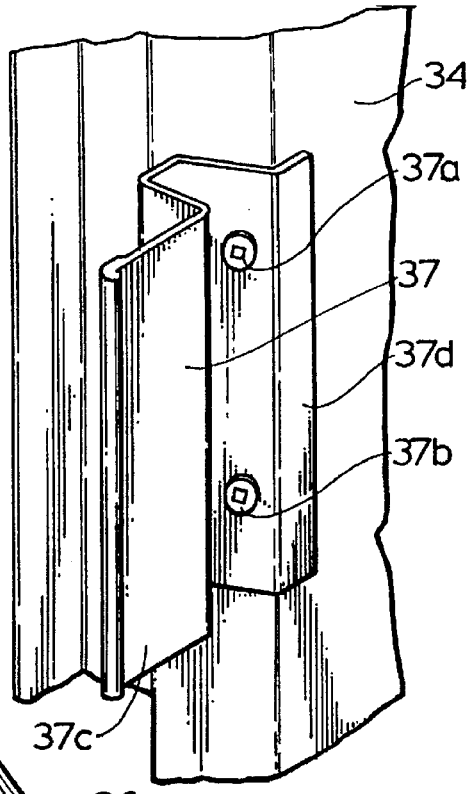
FIG. 14 is a partial perspective view of the outside handle 37 and the components therefor mounted to the framing portion 34 of the moveable closure assembly 30 illustrated in a preferred embodiment of the invention.
Figure 15:
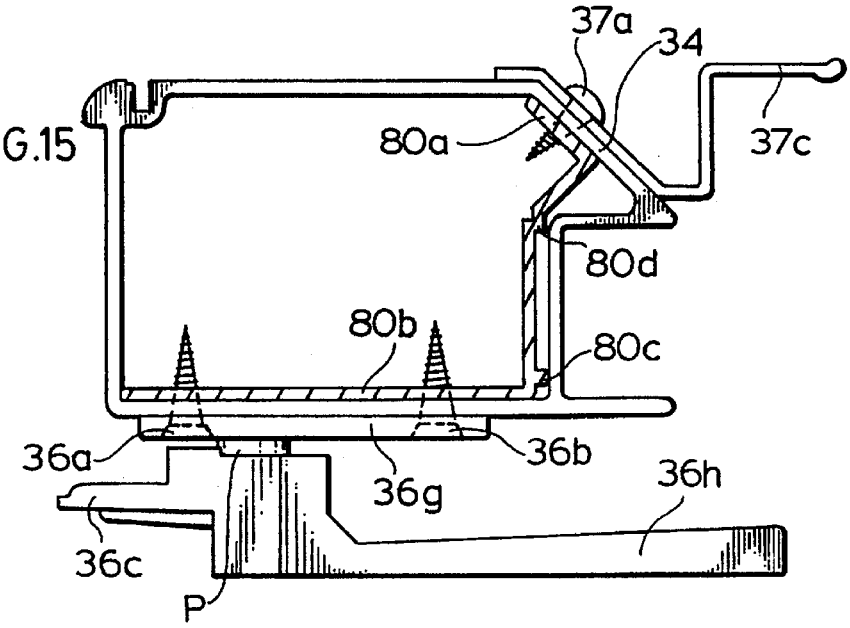

Referring now to FIG. 13, 14 and 15, there is described and illustrated a reinforcing portion 80 which is disposed within the hollow of pultrusion 34. The reinforcing portion 80 is generally L-shaped in cross-section with a slight hook portion at the end of the L. The hook portion extends into a compatibly shaped opening disposed within the hollow of the pultrusion 34 to allow for the fastening of handle portions 37 and 36 to the pultrusion 34. The handle portion 36 includes openings through which fasteners 36a, 36b, 36c, and 36d extend. The handle portion 36 is pivotable via a pivot P. The handle 36h has a locking portion 36c extending at one end thereof remote the handle 36h. The outside handle 37 is formed into a generally U-shaped portion having flanges extending away from the ends of the U. The U-shaped portion includes openings wherein fasteners 37a and 37b are disposed. The handle portion 37c is therefore grippable by an individual. The unique aspect of the enforcing portion 80 is that it will allow the assembly of and fastening of the handle assembly 36 and or handle assembly 37 depending on the needs of the patio door to the pultrusion 34. Thus the pultrusion is connected to the reinforcing portion proximate the assembly 36 via fasteners 36a and 36b, the reinforcement portion then extending away from the lock portion 36 towards the other side of the pultrusion 34, wherein on a slope surface through a fastener 37a that face of the pultrusion 34 is fastened to a web portion 80a of the reinforcing member 80. Thus web portions 80b and 80a are provided to mount both the inside handle and the outside handle. Abutting portions 80c, 80d allow for a good fit of the interconnecting reinforcing portion 80 within the hollow pultrusion 34. It is not necessary that the reinforcing portions of the pultrusion be required to affix handles and the like. In another embodiment of the invention, the reinforcing portion 80 has no fasteners and is merely inserted within the hollow of the pultrusion as a reinforcing portion being connected thereto without the need of handle portions. Such reinforcement would be necessary to improve the strength of the pultrusion under varying loads.

Referring now FIGS. 16, FIG. 16A, FIG. 16B and FIG. 17, there is illustrated one of the cam portions 60 of FIG. 1. In the prior patents to Rokicki there is described the use of the cams as set out in the background of the invention, however, the present invention deals with a unique joint which speeds up the assembly of the doors and eliminates the need of any turn buckles required in the previous preferred embodiment of the inventions of the previous Rokicki teachings. Therefore a cam C is provided having a pivot C1 disposed therewith at one end with a through portion C2 therewith. This pivot portion, for example would be inserted into the truck portions 90 of FIG. 1, as best seen in relation to FIGS. 18 and 19. Specifically referring to FIG. 16A, a block portion C3 is provided having an opening therewith C10 and two openings C9 through which a cable C4 extends one end E1 through the first opening, one end E2 through the second opening. The cable extends around the grooves C6 in use. An opening C5 is disposed within the cam C to contain the block C3 when assembled. In use, the ends of the cable extend through the block through the openings thereof, the block is then inserted within the opening C5 as is clearly seen in relation to FIG. 16b. The ends E1, E2 are then pulled to establish the required tension of the cable as best seen in relation to FIG. 18, so that the cams C will cooperate in motion which are connected by the cables C4 looped in a preferably figure eight fashion. The figure eight is necessary to allow the cams to move in opposite directions when free to do so.

Figure 16:
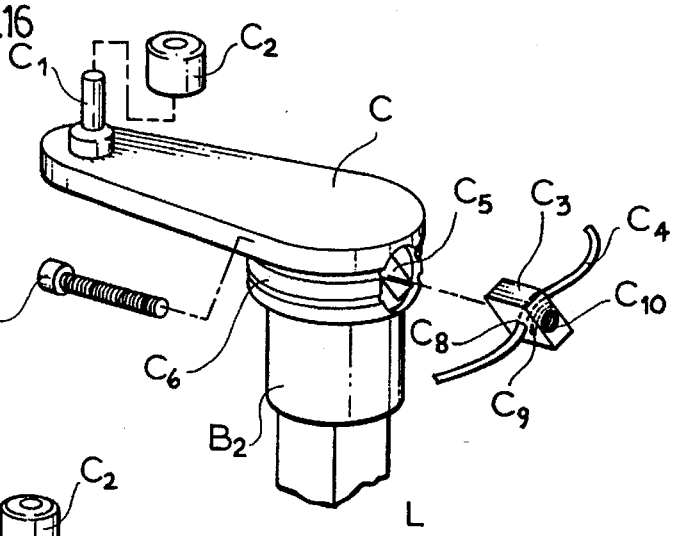
FIG. 16 is an exploded perspective view of the cams illustrated in FIG. 1 showing the interconnection of the components therefor illustrated in a preferred embodiment of the invention.

FIG. 16 illustrates the passage of the cable C4 through a block B3 as a single pass, whereas the illustration in FIGS. 16a and 16b illustrate a double pass through the two openings. This is representative of the two cams found at the top of the patio door assembly. It has been determined that the bottom cams will move in unison with the top cams without an additional cable system located there as well. The cable is passed through the first block illustrated in FIG. 16, looped around 3O the groove C6 and tightened in position. The cable then passes with its ends E1 and E2 through the block C3 at the other end of the patio door assembly, wherein the two ends are pulled tight and the threaded fastener is first fastened in the opening C10 at the end of the block where the cable passes once through the block of the cam and then the fastener C7 is fastened proximate the ends E1 and E2 after the ends have been pulled tight. This assembly is much simpler than the previously known methods using turn buckles and vastly simplifies the construction and most importantly the installation of the assembly in the patio doors. It also has been 10 found that the current cable system is much more reliable than the previous system and will not slip as readily, and is easier to repair.

Figure 17:
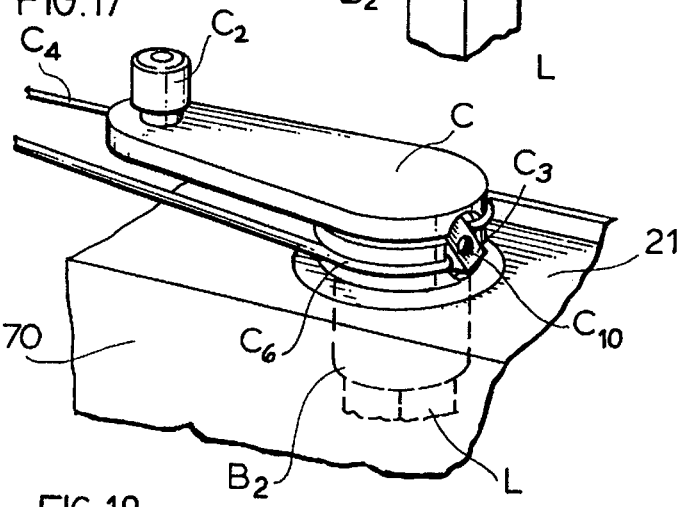
FIG. 17 is an assembled view of the components of FIGS. 16, 16A and 16B.
Figure 18:
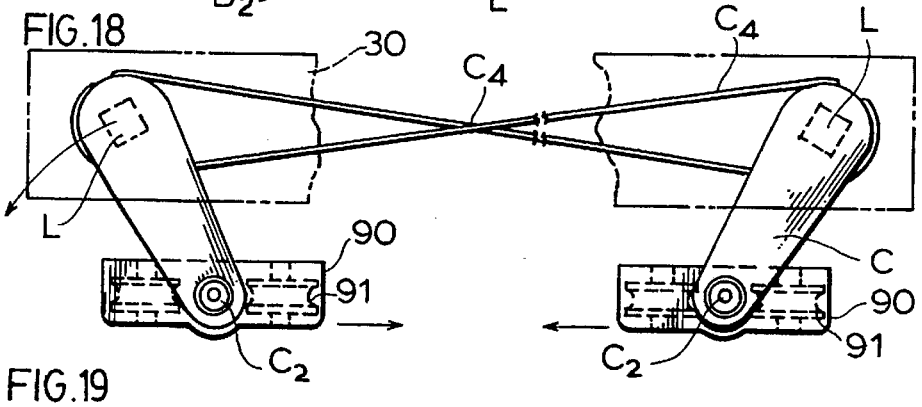
FIGS. 18 and 19 illustrate the motion of the closure member 30 in relation to the truck portions on which the closure assembly 30 slideably moves.
Figure 19:
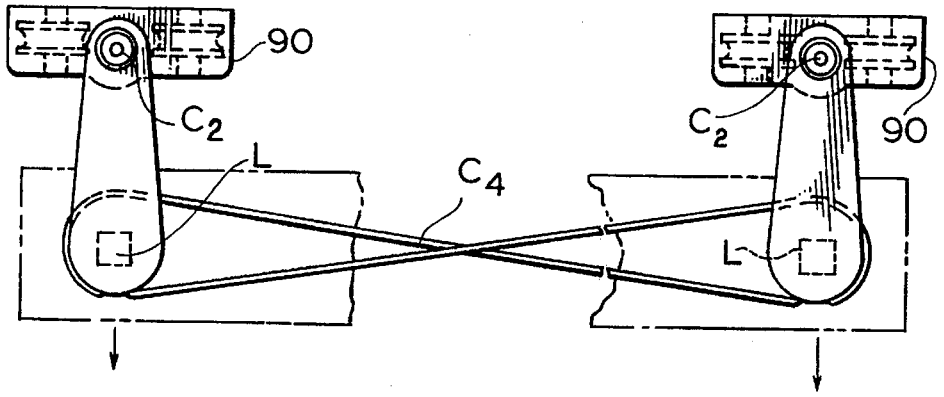

Referring now to FIG. 17, 18 and 19, clearly the assembly is illustrated with the bushings B2, and the link L extending being interconnected to the cam portions C. The cam portion C extend through the framing pultrusions 30 as illustrated in relation to FIG. 11 and 12 through the hollow of the reinforcing portion 70 and is therefore interconnected to the link member L. The link member L extends to the other end of the patio door wherein it will extend to a complementary set of cams reinforcing portions 30 bushings B2. As best seen in relation to FIG. 18 and 19, the resilient member C4 will thus allow the compatible motion of cam portions C whether in the open position as shown in FIG. 19 or in the closed position as shown in FIG. 18. The portion C2 engages openings within the trucks 90 which have rollers 91 which roll along the rib **56*b* of the aluminum extrusion 56** previously illustrated.

As can be seen in relation to FIGS. 18 and 19, the opening C5 of each cam and the distance between the openings in terms of the amount of cable therebetween is a constant because of the fastening of the cable to those openings by the threaded fastener. Therefore, the orientation of the cams is ensured by the compatible motion thereof as required by the patio door assembly of FIG. 1.

Figure 20:
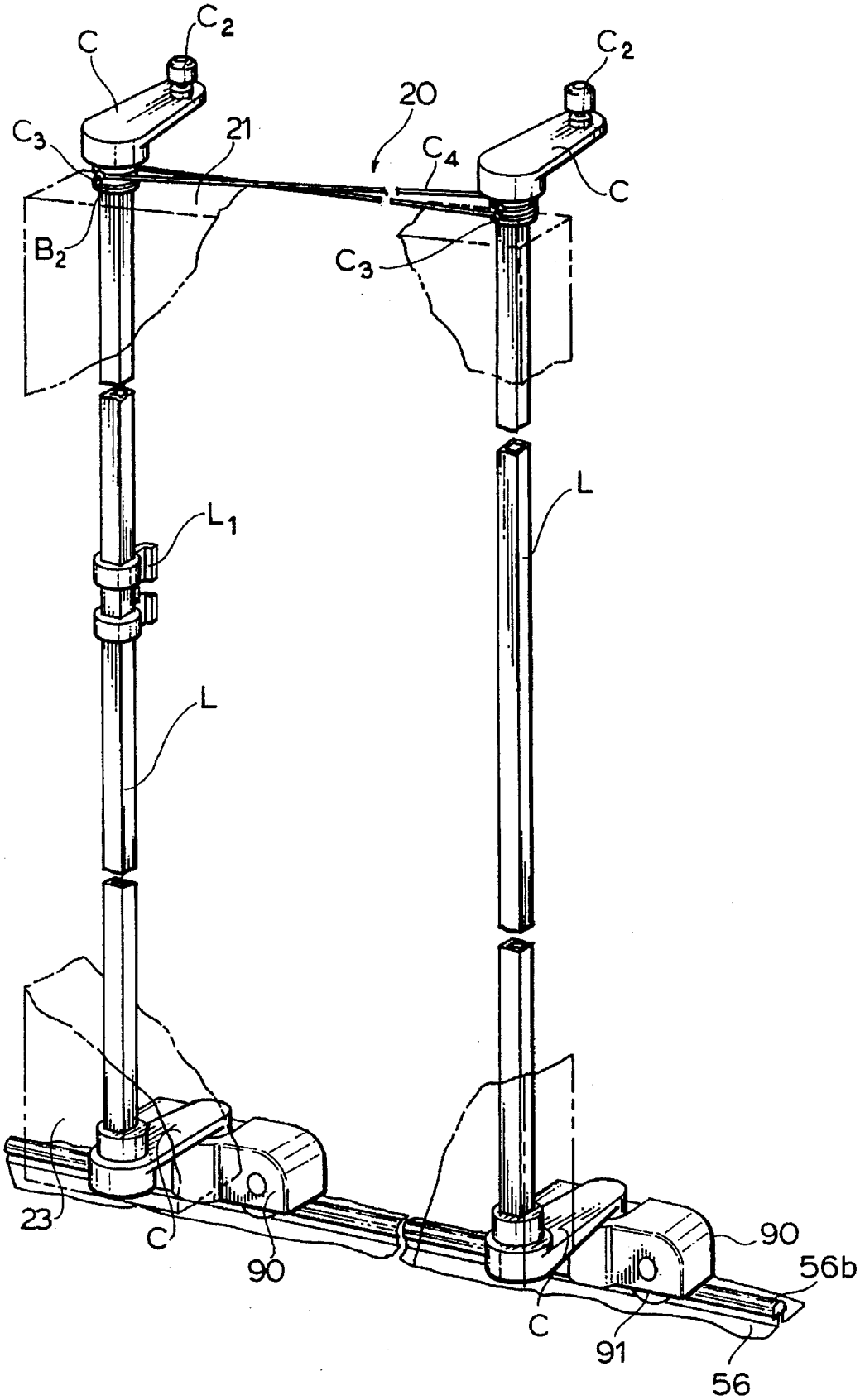
FIG. 20 and FIG. 21 illustrate the corresponding motions illustrated in FIGS. 18 and 19 in a partial cut away perspective view of the patio door assembly of FIG. 1 illustrating the components therein, in a preferred embodiment of the invention.
Figure 21:
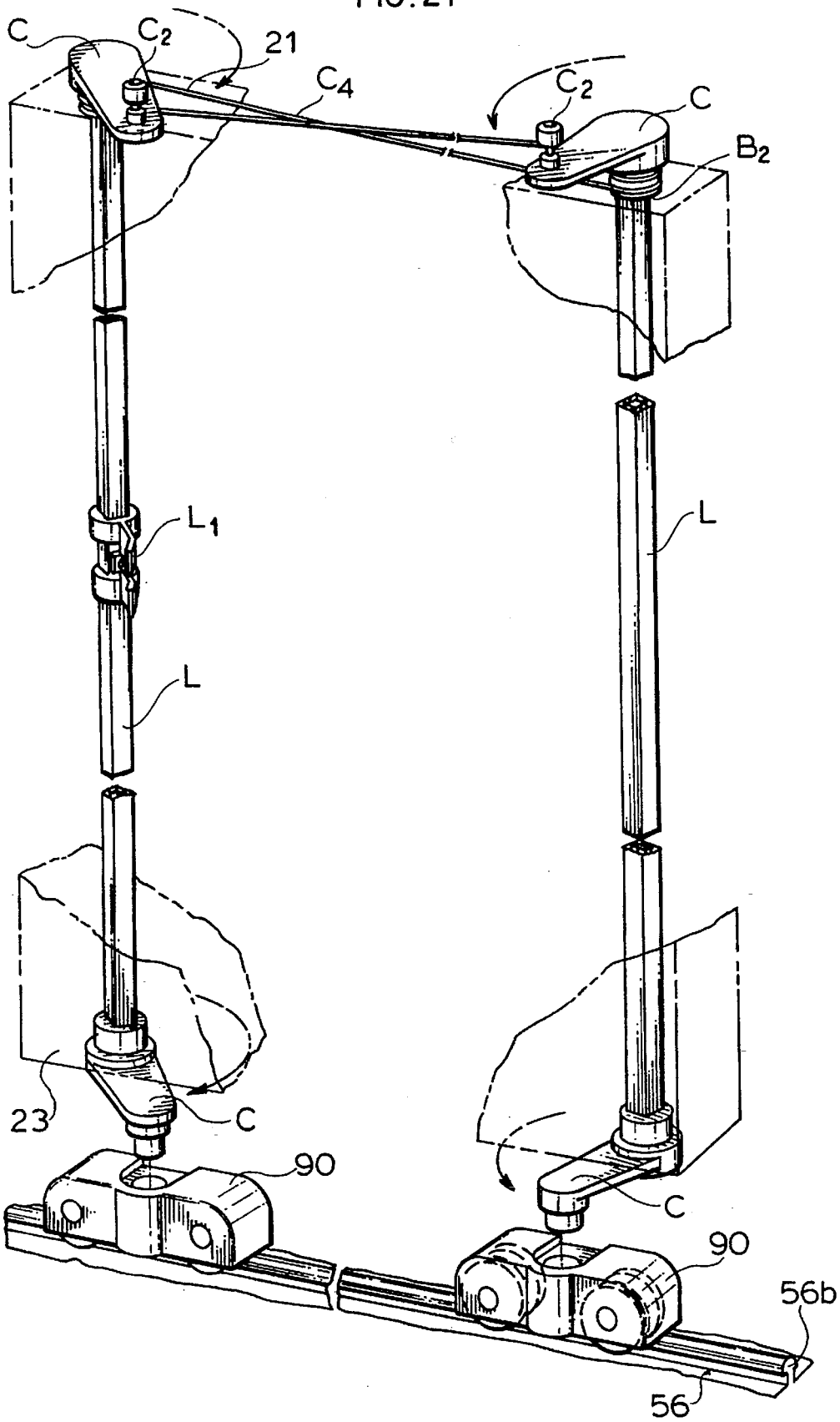

Referring now to FIG. 20 and 21, there is illustrated the components of the linkage linking cams C at one side of the patio door assembly of FIG. 1, with the cams C of the second side of the patio door assembly. Block C3 as previously described above engages cables C4 which ensures the cooperative motion of cams C on the right side of the page and on the left side of the illustration. These cams are interconnected with compatibly positioned cams C disposed at the bottom of the patio door assembly as illustrated in FIG. 1, wherein the trucks 90 are riding on wheels 91 which engage a rib portion **56*b* of the extrusion 56. The extrusion 56 is attached to the pultrusion 23** proximate the bottom of the door assembly. A link portion L interconnects the upper cams and the lower cams thus the cable C4 may be disposed top or top and bottom and ensure the cooperative motion of the cams C in all respects. The structure of the patio door and the links therefore L has been clearly set out in the previous Rokicki teachings. The substance of this invention is the interconnection of the cams by the elimination of the turn buckle on the cable now fastened within the openings C10 of blocks C3 by threaded fasteners C7. This allows for the quick and accurate installation of the patio door assembly whether provided within an aluminum door assembly of a fiberglass door assembly.

Figure 22:
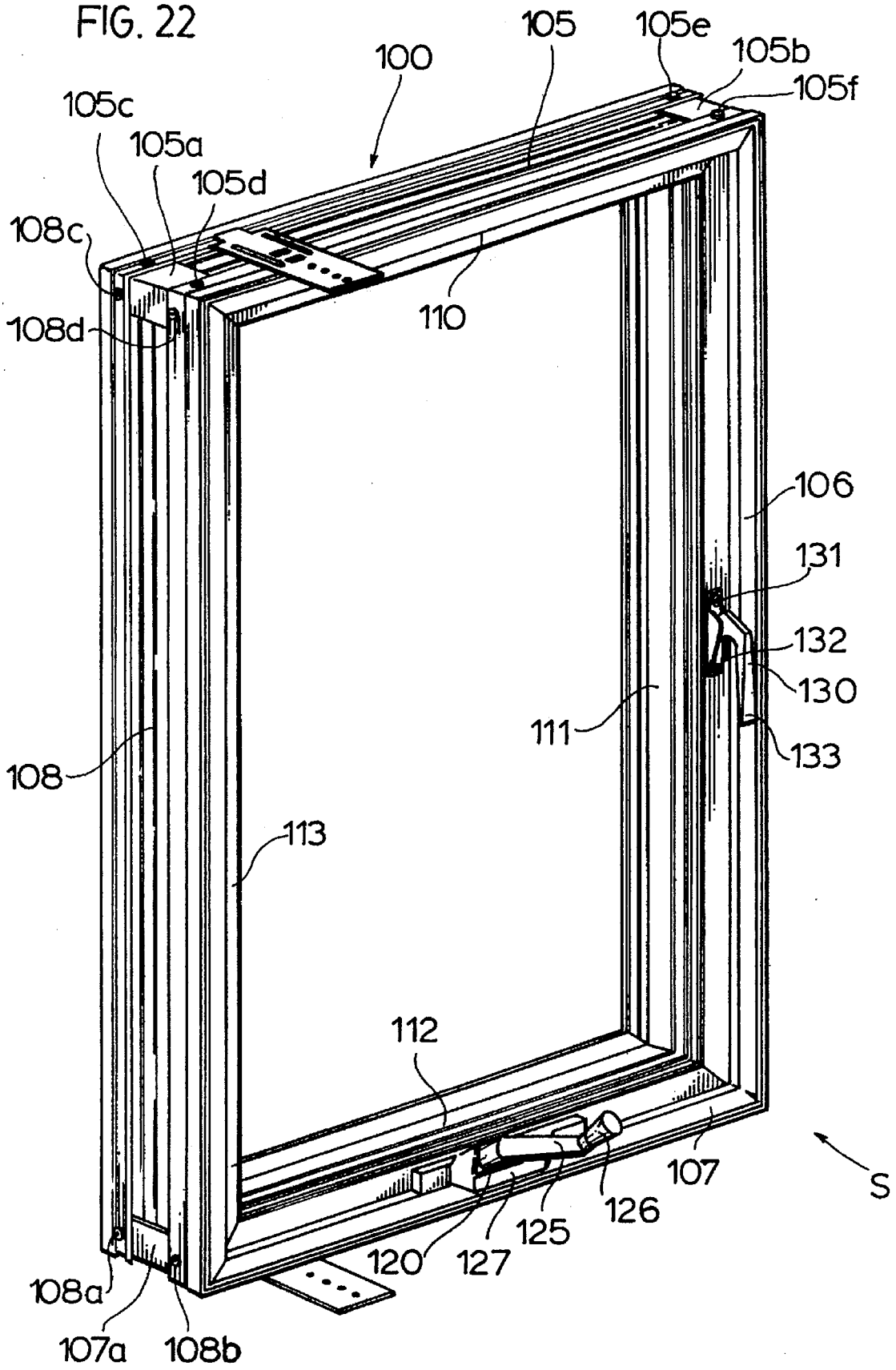
FIG. 22 is a perspective view of a window assembly incorporating components and portions which represent preferred and an alternative embodiments of the invention.

Referring now to FIG. 22 there is illustrated in perspective a window assembly 100 having a framing assembly made up of pultrusions 105, 106, 107 and 108, and a movable or pivotable closure member or window made up of fiberglass pultrusions 110, 111, 112 and 113. Of course as is the case with the door previously described in relation in FIG. 1 through 21 inclusive it is not absolute necessary that the framing portions in alternative embodiments of the invention be pultrusions for a 100% of the framing portions. For example the portions 110, 111, 112 and 113 may be hollow fiberglass pultrusion of 90 thousandths of an inch. The remaining framing sections may in alternative embodiments in the invention be made alternative materials. However, in the preferred embodiment of the invention framing sections as is the case with the framing sections of patio door are made from hollow fiberglass pultrusion of the thickness described above. The framing section 105 is connected to the pultrusion 108 and 106 by a corner reinforcing portions **105*a* which are inserted within co-operative channels supports within the permitter of pultrusion 105, 108 and 106. Similarly pultrusion 108 is connected to pultrusion 107 by a similar corner reinforcing portion 107*a* as it is clearly observe in relations to FIG. 22. Fasteners 105*c*, 105*d*, 105*e*, 105*f*, 108*c*, 108*d*, 108*a* and 108*b* fasten the reinforcing corner portions to respective pultrusions. The handle assembly 130 with the handle 133 and its fastener 131, are illustrated attached to pultrusion 106. This handle of course is as known in the art to lock the window from the inside. Further a pivotable handle assembly 120 is provided disposed upon pultrusion 107 which engages a number of levers by rotations of the handle 126 thus the opening and closing the window supported between the pultrusions 110, 111, 112 and 113**.

Figure 23:
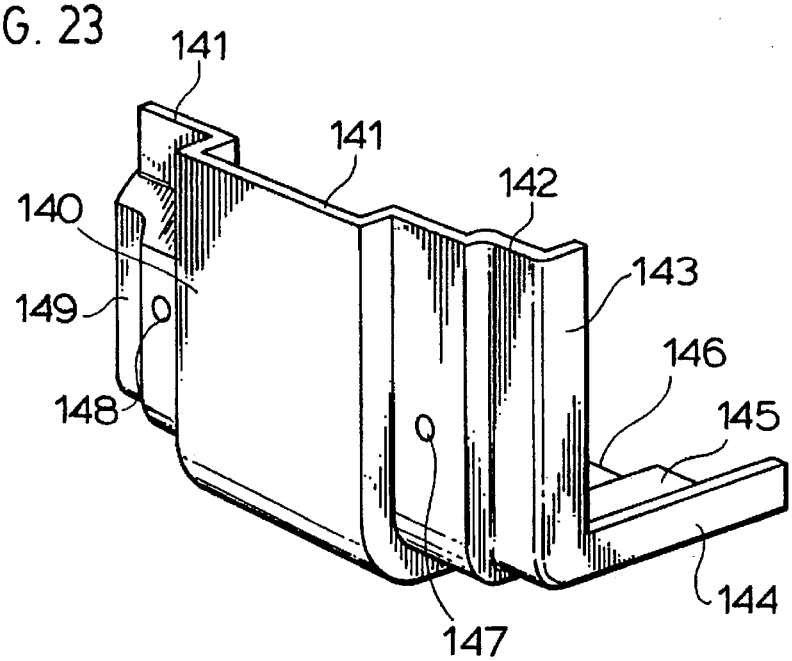
FIG. 23 illustrates a bracket for joining the corners of the outer framing portions of the window assembly illustrated in FIG. 22 in a preferred embodiment of the invention.
Figure 24:
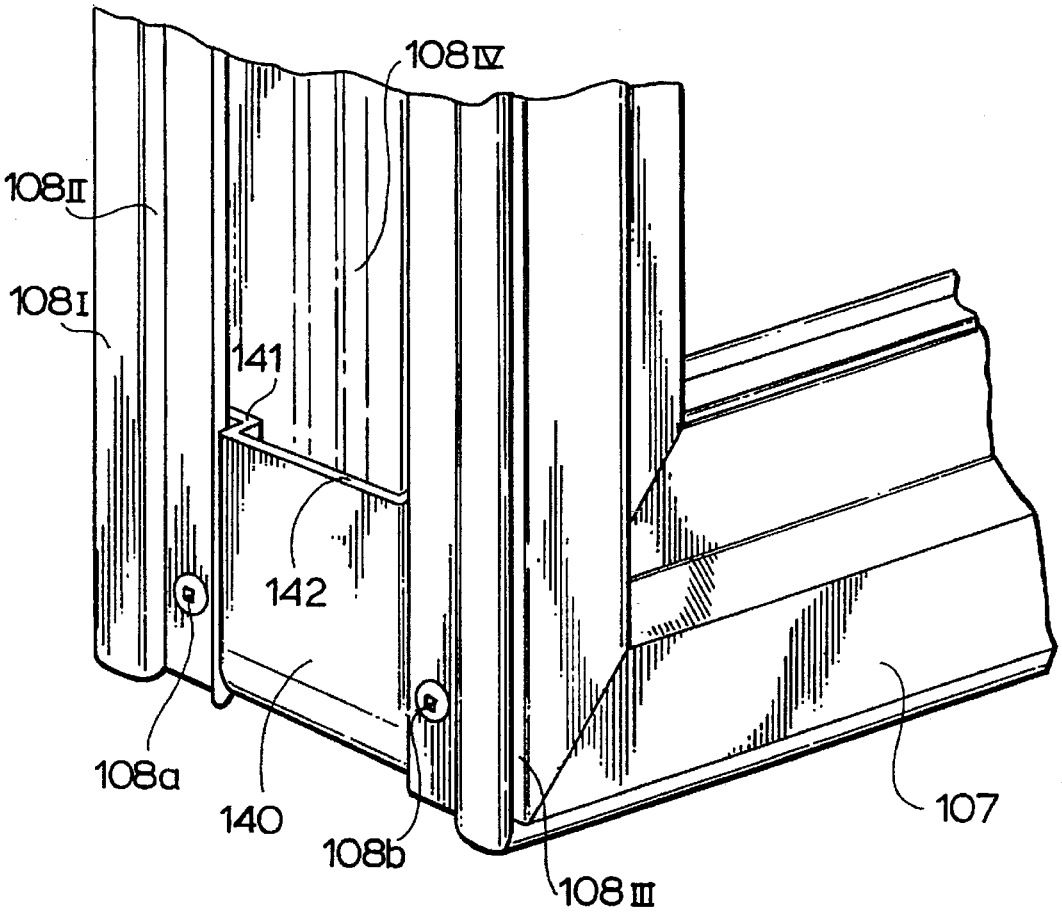
FIG. 24 illustrates the use of the bracket of FIG. 23 illustrated in a preferred embodiment of the invention.

Referring now to FIGS. 23, 24 illustrated there is illustrated therein a bracket portion 140 which is shaped to be inserted within the openings of the pultrusion 107 and the pultrusion 106 as seen in the drawings.

Figure 25:
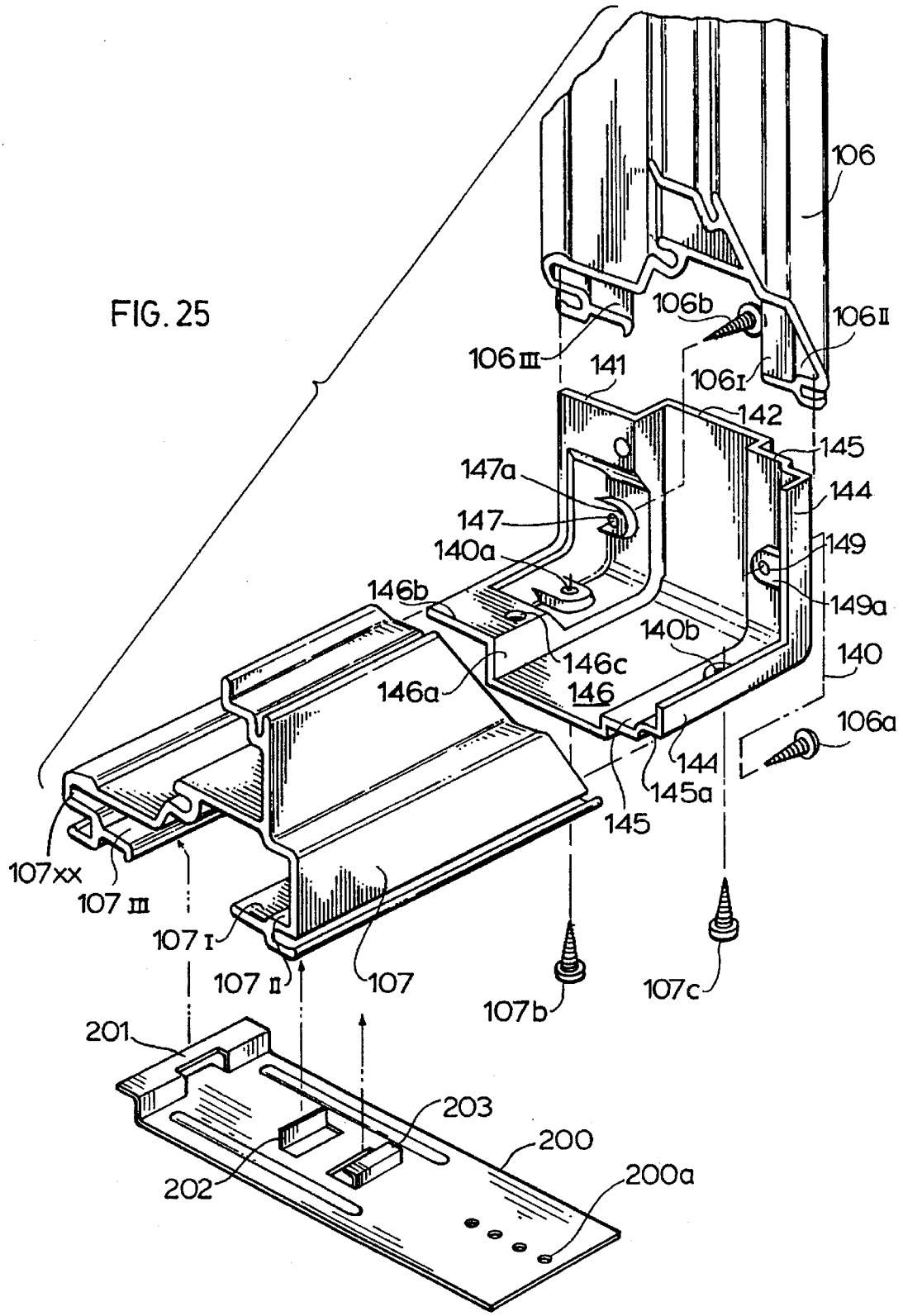
FIG. 25 is an exploded perspective view of the assembled components of FIG. 24 illustrated in a preferred embodiment of the invention.

Referring to FIG. 23 the reinforcing portion 140 includes openings 147, 148, **140*a* and 140*b* wherein fasteners 108*a*, 108*b*, 107*b* and 107*c* will be affixed. The reinforcing portion 140 is preferably made from nylon or other moldable material with conceivable strength and resilience having a portion 141 which extends in use within for example the opening 107*iii* in FIG. 25. Further the flanges 144, 145*a* and 145 will rest upon flanges 107*i* and 107*ii* of pultrusion 107. Similarly the ends 141, 145 and 144 as best seen in FIG. 25 will engages 106*iii*, 106*ii* and 106*i* similarly as in the case of pultrusion 107. Openings 147 and 149 are reinforced by reinforcing portion 147*a* and 149*a* respectively. The same is true for openings 140*a* and 140*b***.

Figures 26, 27, 28:
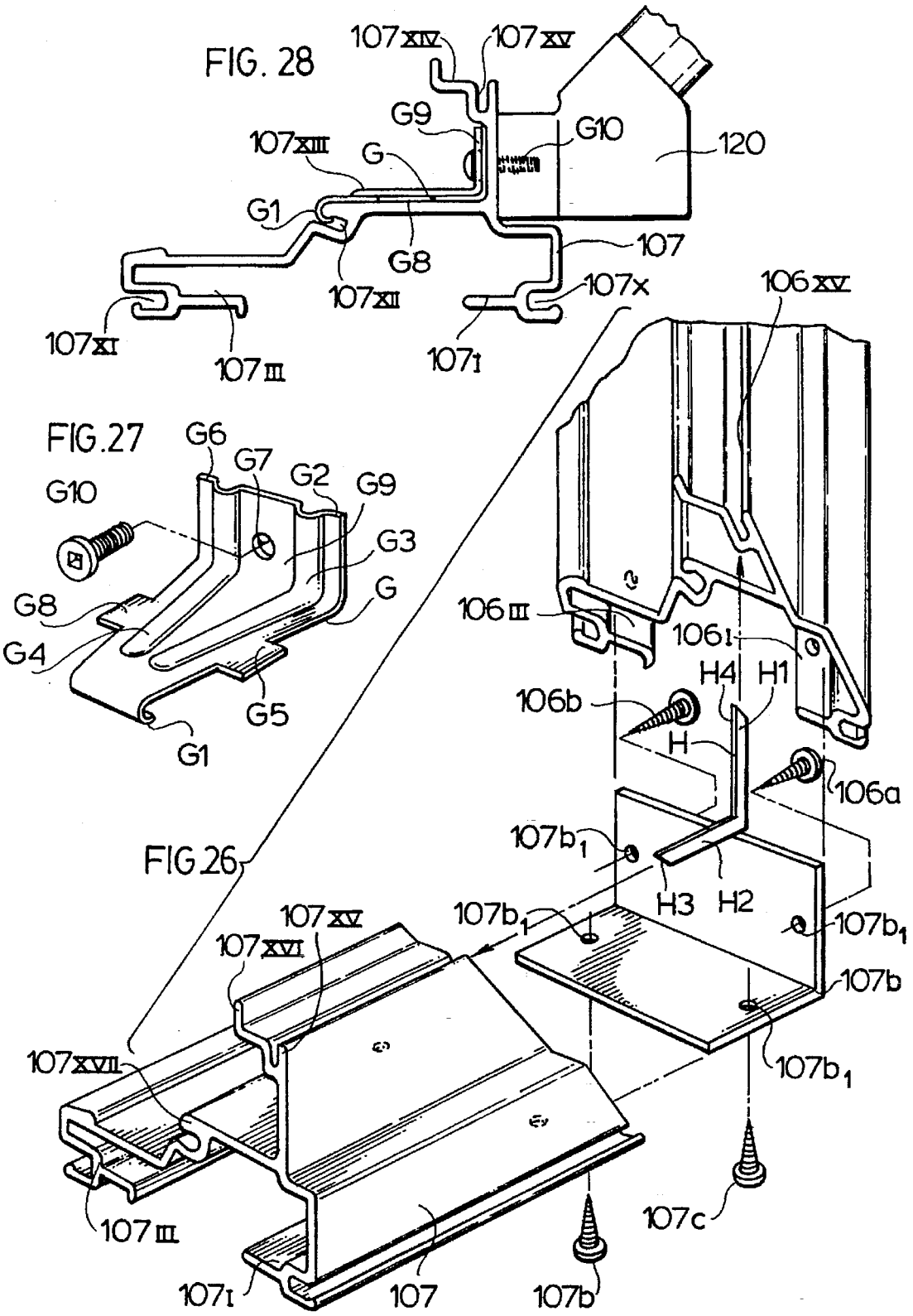
FIG. 26 is an exploded perspective view of a bracket similar to that illustrated in FIG. 25 illustrated in an alternative embodiment of the invention.
FIG. 27 is a perspective view of a reinforcing portion used to mount the window winding assembly 120 of FIG. 22 in a preferred embodiment of the invention.
FIG. 28 is a cross-sectional view from the end 107*a* of FIG. 22 illustrating the use of reinforcing portion G of FIG. 27.

Alternatively referring now to FIG. 26 there is provided a generally rectangular shaped bracket **107*b* as illustrated in relation to FIG. 22 which is an alternative form of the instant invention. The bracket is made from an extruded aluminum angled section included openings 107*b* which align with fasteners 106*b*, 106*a*, 107*c* and 107*b* respectively as shown in FIG. 26. The upwardly extending portion of bracket 107*b* is inserted within the open end and secure above the ramps 106*iii*, 106*ii*, 106*i*, 107*iii* and 107*i* of pultrusion 106 and 107 respectively. Otherwise the fastening thereof is similar to the fastening of the nylon bracket illustrated in FIGS. 23, 24 and 25. Further the pultrusions 107 and 106 include a groove 106*xv* and 107*xv* which engages an angular L shaped member H which has two ends H1 and H2 which are inserted within the groove to align pultrusions 106 and 107** with respect to one another and square the corners therefor when assembled.

Referring now to FIG. 27, 28 and FIG. 1, the reinforcing portion of FIG. 27 includes a generally triangular shaped portion having two ends having a downwardly extending appendage G1 of reinforcing portion G at one end and upwardly extending appendage G2 disposed at the other end thereof. An opening G7 is provided to affix the reinforcing portion within the upward extending flanges 107*xiv*. The fasteners G10 is inserted therefor through the opening of the pultrusion through the opening G7 of the reinforcing portion, the reinforcing portion thus hooking into the groove 107*xii* and the rearward flanges G2 and G6 are oriented to fit within a space between the groove of 107*xv* and the portion G. Reinforcing G4 and G3 extend in triangular fashion along some of the length of reinforcing portion G extending upwardly through to flanges G6 and G2 which stopping short of a hook portion G1. Clearly it can be seen that the reinforcing portions, normally two, are supposed to allow the portions G8 and G5 to extend within the channel of pultrusion 107 wherein portion G8 at the top of the pultrusion thereby allows the fixing and positioning of window winding mechanism 120 of the window assembly 100. As many reinforcing portions that are necessary to adequately fix the reinforcing member to the window winding assembly may be provided. The fastening is done from the channel side of the pultrusion of the framing section 107 thus providing for a clean package hiding the fasteners yet reinforcing the window winding mechanism to the fiberglass pultrusion without the need of continuous inserts which are solid such as wood etc.

Referring now to FIG. 29 and 29*a* there is provided the bracket similar to the structure found within FIGS. 11 and 12 accept that the bracket is not hollow but is made from moldable material such as plastic, polyethylene, fiberglass, nylon or the like. The plastic member 150 is provided with a top and bottom having disposed at the sides thereof reinforcing ribs 153 to reinforce the flanges 152 and 151 at one side thereof without the need to provide a solid form. Thus the webs are separated by openings allow for economy in forming the bracket 150. Openings 150*a* and 150*b* are provided which allow for the fastening of pultrusions 112 and 111 via openings 111*e* and 112*e* to the bracket faces. The brackets has portions 154 and 155 wherein the portions of the generally L shaped bracket meet further having flanges 152 and 151 whereat angled surfaces 151*a* and 152*a* extend into the openings 111*a* and 112*a* in use to allow the faces 151 and 152 to fit within the opening 112*a* and 111*a*. When the surface 111*g* abuts the surface 154 then the bracket will be assembled and fastened in position in relation to the pultrusion 111 and 112. A seal 112*i* is disposed within the groove 112*c* and 111*c* with pultrusion 112 to provided a circumferential seal around the closure member. The closure assembly therefor is assembled by use of such bracket 150 having co-operative portions 150, 151 and 152 which engage with co-operative channels 111*a* and 112*a* with the respective pultrusions thereby fastening the assembly. All four corners are joined by such a preferred bracket.

Figure 31A:
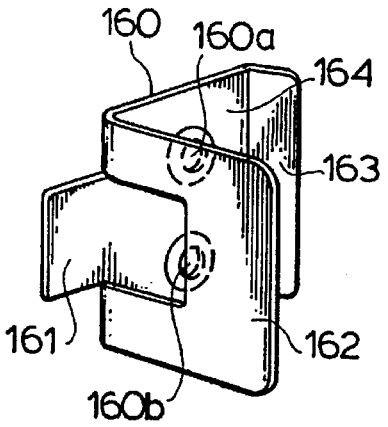
FIG. 31A is a perspective view of the reinforcing portion illustrated in FIG. 31.
Figure 31:
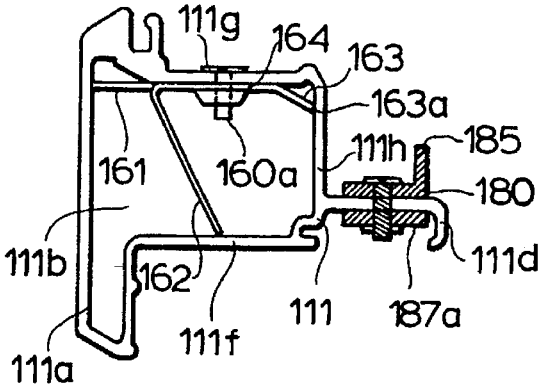
FIG. 31 is a cross-sectional view of the framing portion embodying the moveable closure member of window assembly 100 including a reinforcing portion within the hollow of the framing portion illustrated in a preferred embodiment of the invention.
Figure 31B:
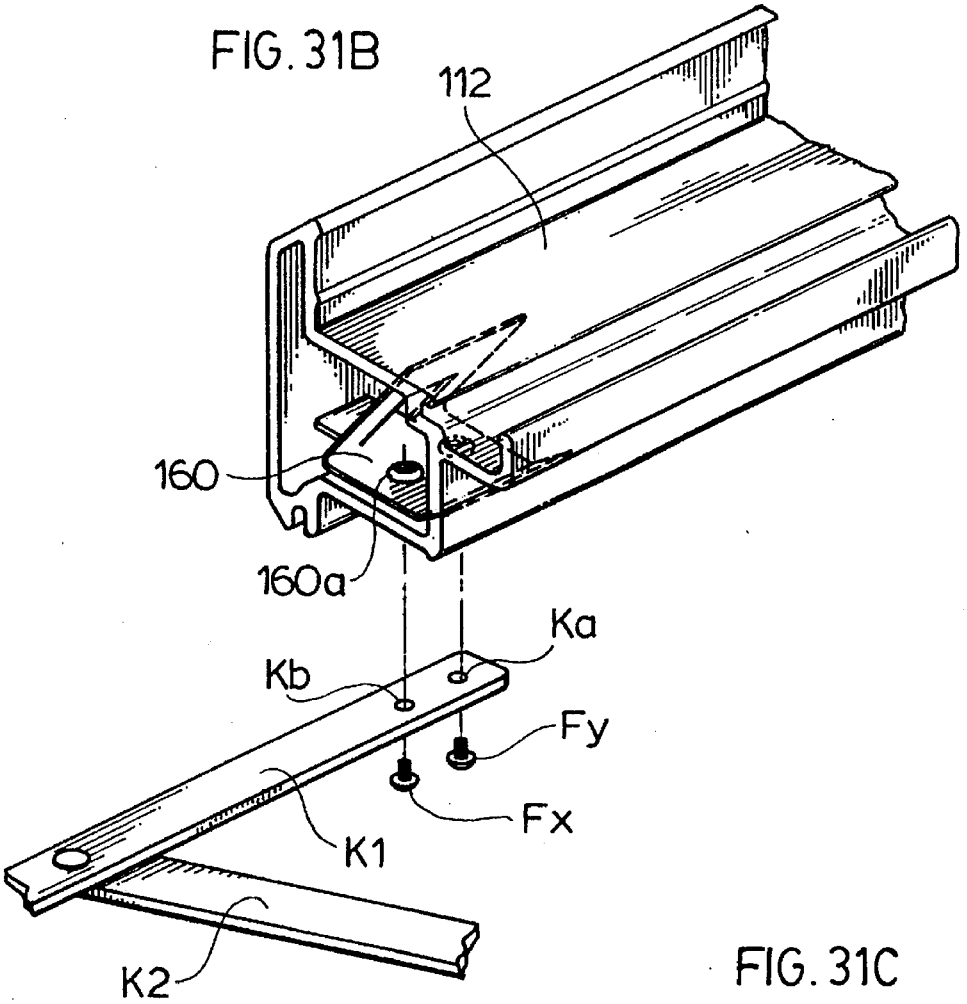
Figure 31C:
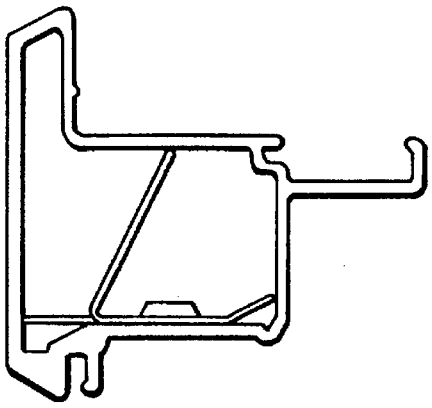

Referring now to FIG. 31 and 31*a* there is provided a reinforcing portion 160 having two ends and having disposed proximate one end outwardly extending tang 161 and proximate the other end a upperly extending tang 163. Further the reinforcing portion 160 has an upperly and angularly extending portion extending upwardly from near the tang portion 161. Such portion is label as 162. Openings 160*a* and 160*b* are disposed on the bottom of the reinforcing portion in the same plane as tang 161. The reinforcing portion is fastened through an opening in pultrusion 111. The fastener 160*a* fastens a pultrusion and the reinforcing 3O portion together allowing for the reinforcing portion to reinforce the profile of the pultrusion 111. The upperly angularly extending portions 162 abuts the pultrusion at surface 111f via abutting portion 162*a*. Further the upperly extending tang 163 abuts the pultrusion at surface 111*h* and the tang portion 161 abuts the pultrusion remote 111*h*. Thus it is found that in between the corner brackets of FIGS. 29 and 29*a* there is disposed the reinforcing portion for further reinforce the pultrusion in use. Further the reinforcing bracket allows the fastening of the lever K1 as best seen in FIG. 31B to the pultrusion 112 of FIG. 22. As the window will be supported by the framing sections 110 and 112 when pivoting it is important that the reinforcing bracket 160 of FIG. 31A be located within the pultrusion aligned with openings in each pultrusion whereat the fasteners will not only reinforce each pultrusion 110 and 112, but will also serve to fasten the levers K1 and K2 to each pultrusion at openings Ka and Kb.

Figure 33:
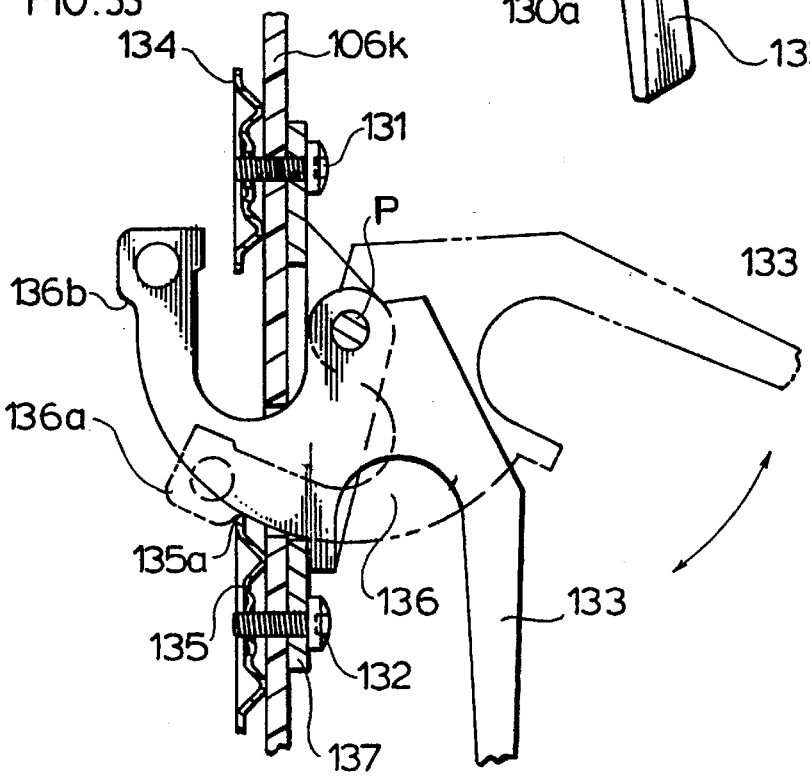
FIG. 33 is a side cross-sectional view in elevation of the handle assembly of FIG. 32 illustrated in a preferred embodiment of the invention.
Figure 34:
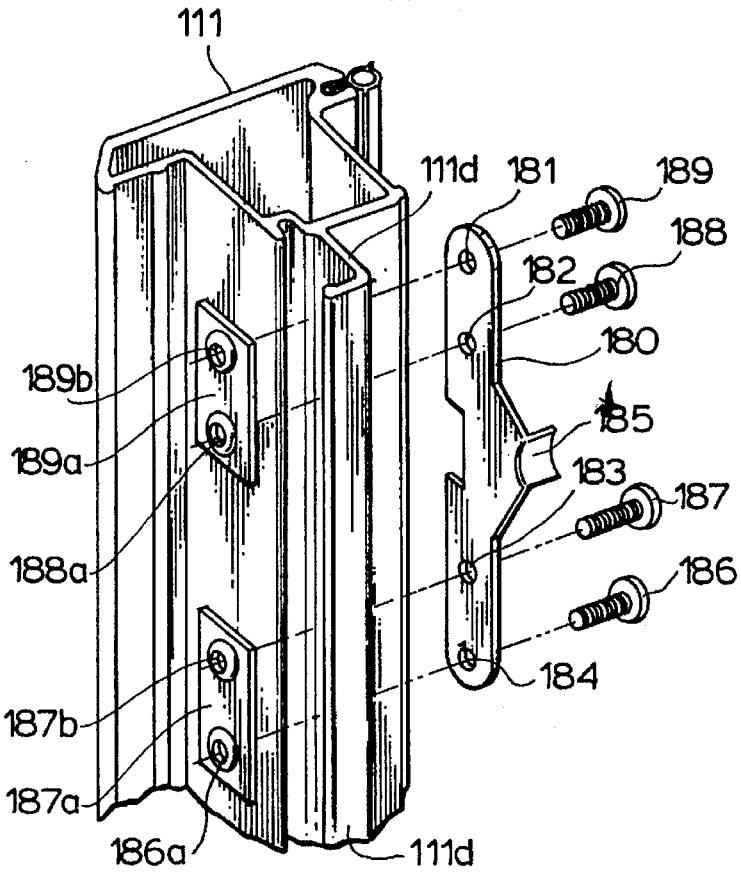
FIG. 34 is a exploded perspective partially cut away view of framing portion 111 of the moveable closure of the window assembly of FIG. 22 showing the mounting of the striker assembly on the hollow framing portion 111 thereof illustrated in a preferred embodiment of the invention.
Figure 34A:
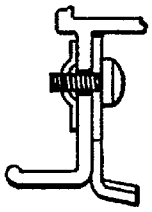

The pultrusion further includes a flange portion 111*d* which extends from the main body of the pultrusion to which a further reinforcing portion, which is best described in relation to FIG. 34, is disposed to connect the striker portion compatible with assembly 130 of the window assembly. The latch portion 180 is therefor described in cross-section having a fastener to fasten the portion in position with the reinforcing portion 187*a* disposed therewith to engage the other side of the flange 111*d*. Such assemblies are clearly shown in relation to FIG. 34 wherein the reinforcing portions 189*a* and 187*a* are provided with openings 189*b* and 188*a*, 187*b* and 186*a* respectively which connect to the other side of flanges 111*d* with fasteners 89, 187, 186 and 188. The fasteners extend through openings 181, 182, 183 and 184 of bracket member 180 which includes a striker portions of 185 which will engage the lever assembly 136*b* best illustrated in FIG. 33. Therefor reinforcing portions 189*a* and 187*a* are required to properly mount the hardware 180 in the proper location the reinforcing portions as best seen in relation to FIG. 31 and 34 are flat essentially in profile having corrugated openings.

Figure 30:
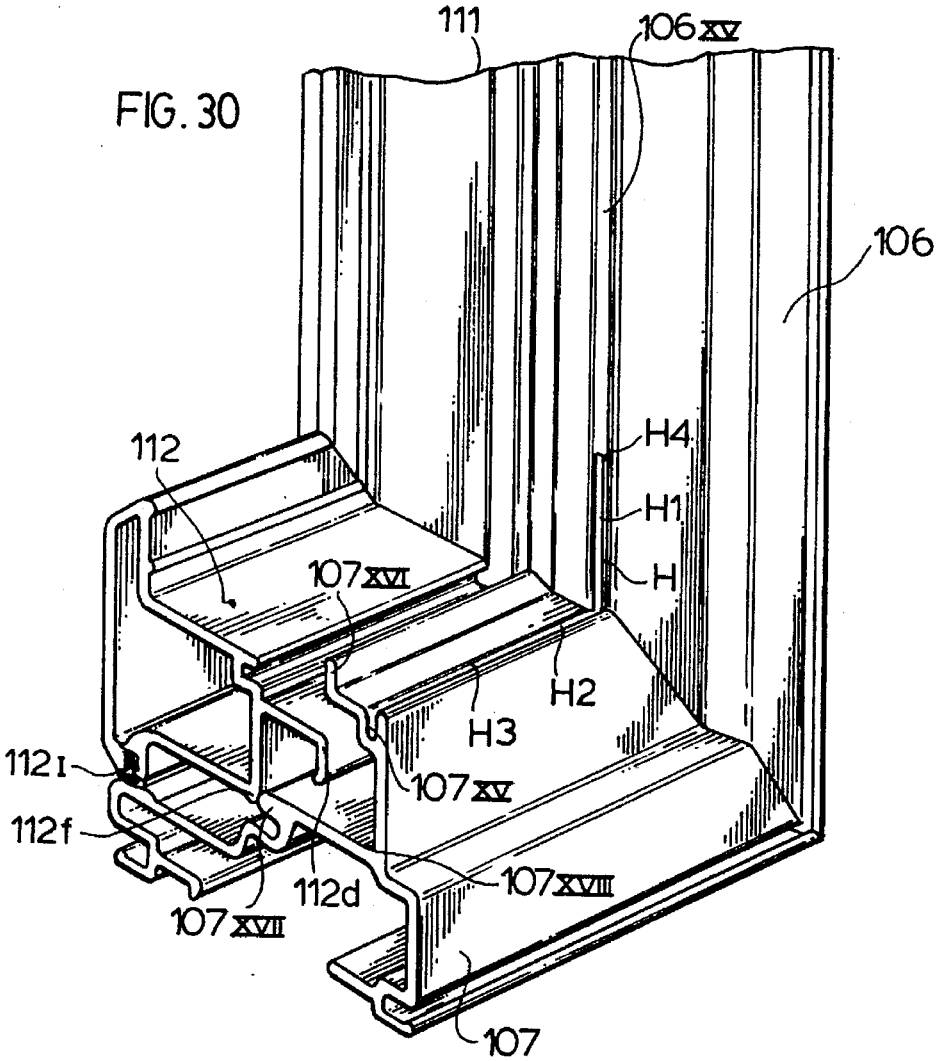
FIG. 30 illustrates a cut away perspective view of the fixed framing portion and the moveable framing portion of the window 100 illustrated in FIG. 22, illustrating the interrelationship of the components therefore illustrated in a preferred embodiment of the invention.

Referring now to FIG. 30, there is illustrated a connected corner of the window assembly proximate corner S of FIG. 22 shown the squaring portion H having ends H2 to H3 and H4 support with a compatible shape groove 107*xv* and 106*xv*. Therefor the pultrusions 106 and 107 comprise the outer framing section and the pultrusion 111 and 112 comprise the inward movable portion wherein a downwardly extending portion 112*d* will abut underneath the fully extending flanges 107*xvi*. The edge 112*f* will abut above the edge 107*xvii*, the seal 112*i* will abut just below portion 107*xvii* wherein 112*f* will finally upon complete closure of the window rest adjacent 107*xviii* with the seal 112*i* located proximate 107*xvii*. All of the pultrusions in this example are hollow and reinforced at predetermined location as required by the strength of the assembly. The larger breadth that the framing section may have to span, then the greater the reinforcing requirement. However in all cases the reinforcing are discreet reinforcing portions which also serve as mounting brackets and are not continuous reinforcing portions extending the full length of the pultrusion but are localized only. In other aspects of the invention the reinforcing portions may extend the full length of the pultrusion. For example the reinforcing portion of FIG. 31 and 31*a* may extend the full length of the pultrusion even though the pultrusion is hollow and still providing reinforcing portions therein.

Figure 32:
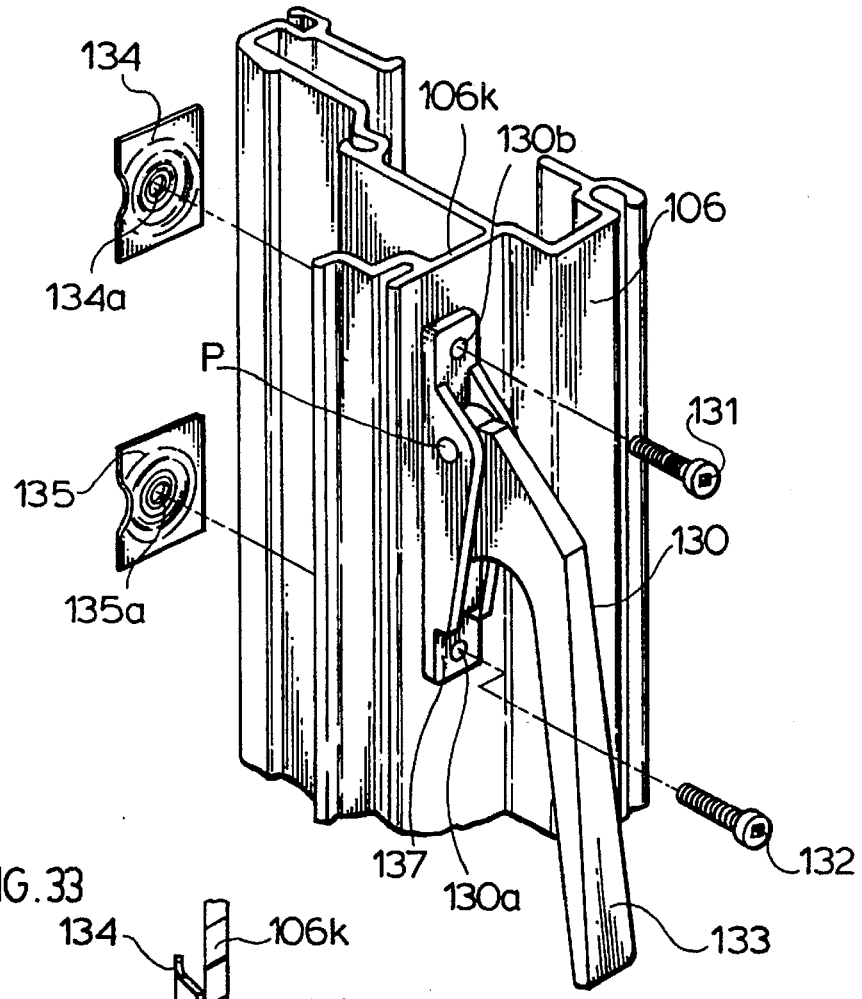
FIG. 32 is a cut away exploded perspective view of the handle assembly 130 of FIG. 22 mounted to the hollow framing section 106 thereof and illustrated in a preferred embodiment of the invention.

Referring now to FIG. 32 and 33 there is provided handle assembly 130 pivotable upon a pivot P within the housing 137 of the assembly. Disposed within the assembly are openings 130*b* and 130*a* which fasteners 132 and 131 fasten the handle assembly through the pultrusion 106 to the flange portion 106*k* thereof. Reinforcing portions 134 and 135 are provided with openings 134*a* and 135*a* respectively which engage with the fasteners 131*a* and 132 to fasten the handle mechanism on the hollow profile at flange 106*k*. The portion 136*a* and 136*b* engage with the edge 135*a* of the reinforcing portion 135 respectfully which acts as stops when the handle pivots in the direction indicated and moves from a horizontal position to substantially vertical position whereat the window would be locked. An arcuate portion 136 connects the handle to the end 136*b* of the locking portion which engages underneath the striker portion 185 as best illustrated in FIG. 34. Locking handle portions are already known in the art. It is the mounting of the handle assembly to the pultrusion by the reinforcing portion 134 and 135 that is the substance of the invention and preferably in combination with the hollow profile of the pultrusion. Any reinforcing portion similar in use to items 134 and 135 which fit within the require openings adjacent flanges 106*k* will be suitable.

Figure 35:
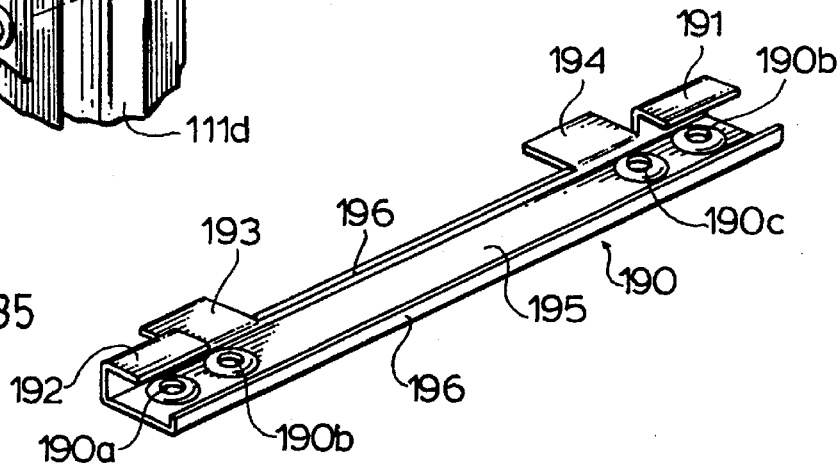
FIG. 35 is a perspective view of a reinforcing portion 190 inserted within the hollow of a framing portion 107 as illustrated in FIG. 25 shown in a preferred embodiment of the invention.
Figure 36:
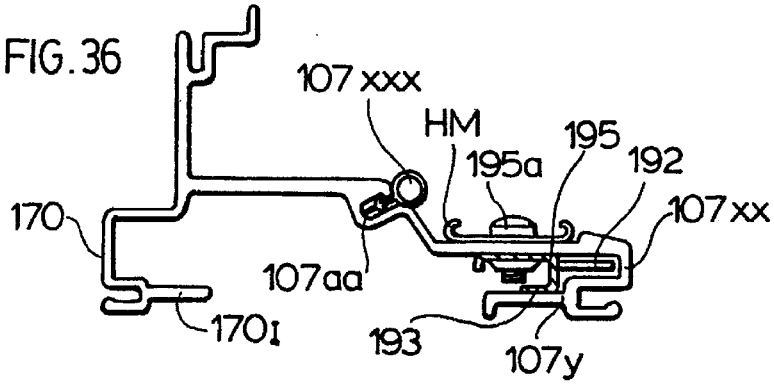
FIG. 36 is a cross-sectional view of the profile of FIG. 25 illustrating the use of the bracket portion illustrated in FIG. 35 shown in a preferred embodiment of the invention.

Referring now to FIGS. 35 and 36 there is provided a mounting bracket 190 having two ends and having disposed proximate each end openings 190*a*, 190*b*, 190*c* and 190*d* respectively. At the end of proximate the openings 190*a* is disposed a flange portion 192 extending parallel to the plane in which the openings 190*a* and 190*b* are disposed. Below this plain but in a substantially parallel plane yet above the plane which the openings 190*a* and 190*b* are disposed there is another tang portion 193 extending opposite in direction to the tang portion 192. The same is the case in relation portions 194 and 191 found adjacent the openings 190*c* and 190*d* of the bracket. The bracket further includes a upwardly extending edge 196 proximate each side of the reinforcing bracket. It is clearly seen in relation of FIG. 36 the portion 193 abuts the flange 107*y* by reinforcing the flange should a force extend downwardly on the flange tending to compress it. Further the reinforcing tab 194 extends into the recess bounded by end 107*xx* further reinforcing the hollow profile. The hollow profile is attached to the reinforcing portion via a threaded fasteners 195*a* and a opening 190*a*, 190*b*, and 190*c* respectively thus allowing planer portion 195 to lie flat against the flanges portion and thereat securing a hinge mechanism HM to the hollow profile 107. The hinge profile is not shown but would be that hinge profile which is conventually used in relation to the assembly 120 as best illustrated in FIG. 22 including levers and rods to open and close the window frame comprising pultrusions 110, 111, 112 and 113 and swinging it pivotably such as a door on a door hinge in relation to the stationary frame comprising pultrusion 105, 106, 107 and 108. The handle 126 is connected to a worm and worm gear. When the handle 126 is rotated the worm, not illustrated, rotates,the worm having a helical thread running down the length of it and engaging with a sector or worm gear having a lever assembly attached to the sector at one end and to pultrusions 110 and 112 proximate the other end whereat reinforcing portion 160 of FIG. 31A is disposed. The top portion attached to 110 of FIG. 22 is slaved to the bottom portion 112. This general structure is know in the art but not in relation to hollow pultrusions. It is the fastening of the hinge assembly HM in FIG. 36 via the reinforcing portion 190 disposed within the hollow profile adjacent flanges 107*y*, 107*x* and 107*xx* which is a portion of the invention of this application. A seal 107*xxx* is disposed in a groove 107*aa* of the profile of FIG. 36. Clearly the profile of FIG. 36 is identical to the profile of FIG. 25. Referring to FIG. 25 within the opening 107*iii* there is positioned but not illustrated this reinforcing portion of FIG. 35 the tang portion 192 extending into the groove established by outwardly extending arcuate portion 107*xx*.

Referring now to FIG. 22 and FIG. 25 there is disposed a nailing flange 200 which has unique properties. Not only does the nailing flange act as a reinforcing portion for the pultrusion to which it is connected, but it also forms a strengthening box beam with the pultrusion. Further the nailing flange 200 has detent portions 201 202 and 203 which engage the flanges and grooves 24*f*, 24*h* and 24*g* as best seen in FIG. 2. It is customary to provide nailing flanges with window assemblies. Nailing portion 200 offers unique advantages of mounting and strengthening when used with hollow pultrusions.

Although the reinforcing portions as described herein in relations to illustrations of FIG. 1 through FIG. 36 are shown in preferred embodiments, many alternatives structure may be design by those skilled in the art in light of the teachings of this disclose which include profiles in reinforcing portion which reinforce thin wall pultrusions and join the thin wall pultrusions together and prevent the ripping, tearing and shredding of the fiberglass. Reinforcing portions which allow for the mounting of hardware to the thin walled hollow pultrusions such as the hardware of assembly 120 and 130, 136 and 137 with patio door system are considered part of this invention. Any reinforcing portion which allows for the strengthening of hollow pultrusion and truly reinforces would perform equally as well whether it serves the double function of a mounting bracket or not. It is impossible to describe all the different embodiments reinforcing portions may take. All matter contained within the description of the preferred embodiment and alternative embodiments of the invention are considered to be represented of those which may be design by those skilled in the art to be analogous in use and therefor mechanical equivalents.

As many changes can be made to the preferred and alternative embodiments of the invention without departing from the scope of the invention; it is intended that all material contained herein by interpreted as illustrative of the invention and not in a limiting sense.

The embodiments of the invention in which an exclusive property or privilege is claimed are as follows:

1. A closure assembly having framing sections and assembled at predetermined points with fastening means and having hardware fastened to the closure assembly at predetermined points with fastening means, said closure assembly comprising a thin walled fiberglass pultrusion having a predetermined cross section including three surfaces and having two ends and providing the framing sections for forming the closure assembly and including discrete reinforcing means fastened and positioned at discrete locations at the ends of the pultrusions or where hardware is fastened with the pultrusion, each reinforcing means having complementary pultrusion butting and engaging portions disposed therewith which engage with complementary reinforcing means butting and engaging portions of the pultrusion to allow for the joining by said fastening means of; the framing section in the closure assembly, the hardware associated with the assembly to the assembly, and adjacent pultrusions to one another while reinforcing the framing sections in use from cracking or breaking proximate at least three surfaces of said cross section of said pultrusion in at least three planes as the fastening means are fastened to the discrete reinforcing means distributing any fastening stresses tending to locally crack or break the pultrusion adjacent the point of fastening to the reinforcing means and to a substantially greater cross sectional area than the immediate surrounding surface of the pultrusion proximate the point of fastening, wherein the pultrusion is of a thickness of substantially in the range of between twenty five and ninety thousandths of an inch.

2. The pultrusion of claim 1 wherein the reinforcing means are discrete discontinuous reinforcing portions which are fastened to predetermined portions of each pultrusion such as channels, grooves, or flanges provided with the pultrusion when formed.

3. A framing section for doors and windows assembled by fastening means and comprising a thin walled fiberglass pultrusion having a predetermined cross section including three surfaces and two ends, the pultrusion having formed therewith at least one complementary butting and engaging portion, in use said pultrusion of the framing section having disposed proximate at least one end thereof first reinforcing means having complementary butting and engaging portions disposed therewith compatible in shape with the at least one complementary butting and engaging portion of the pultrusion and for fastening of the pultrusion with like pultrusions in forming a framing section while reinforcing the framing section in use from cracking or breaking proximate at least three surfaces of said cross section of said pultrusion in at least three planes as fastening means are fastened to the first reinforcing means, the first reinforcing means distributing any fastening stresses, tending to locally crack or break the pultrusion adjacent a point of fastening, to the reinforcing means and to a substantially greater cross sectional area than the immediate surrounding surface of the pultrusion proximate the point of fastening, wherein the wall thickness of the pultrusion is substantially in the range of twenty five to ninety thousandths of an inch.

4. The pultrusion of claim 3, wherein the first reinforcing means includes three dimensional corner brackets, having mounting means which are inserted in cooperative channels within the perimeter of the pultrusion.

5. The pultrusion of claim 4, wherein the corner brackets are made from nylon.

6. The pultrusion of claim 5, wherein the corner brackets include arms, said bracket being an angle bracket being substantially L shaped, the arms of the bracket being affixed to proximate the end of each pultrusion when the frame is assembled.

7. The pultrusion of claim 3 wherein the first reinforcing means further comprises a reinforcing member having compatible portions which engage with the pultrusion and allow fastening thereof to adjacent pultrusions proximate the end of the pultrusion.

8. The pultrusion of claim 7, wherein the first reinforcing means having portions therewith, the pultrusion or adjacent pultrusions being connected thereto.

9. The pultrusion of claim 8, wherein the detent portions are cylindrical channels for receiving threaded fasteners.

10. The pultrusion of claim 3 wherein each pultrusion has disposed therewith at predetermined locations second reinforcing means for mounting hardware means, the second reinforcing means preventing cracking or breaking of the pultrusion proximate the hardware means when the hardware means is mounted thereto.

11. The pultrusion of claim 4, wherein each pultrusion has disposed therewith at predetermined locations second reinforcing means for mounting hardware means, the second reinforcing means preventing cracking or breaking of the pultrusion proximate the hardware means when the hardware means is mounted thereto.

12. The pultrusion of claim 7, wherein each pultrusion has disposed therewith at predetermined locations second reinforcing means for mounting hardware means, the second reinforcing means preventing cracking and breaking of the pultrusion proximate the hardware means when the hardware means is mounted thereto.

13. The pultrusion of claim 8, wherein each pultrusion has disposed therewith at predetermined locations second reinforcing means for mounting hardware means, the second reinforcing means preventing cracking or breaking of the pultrusion proximate the hardware means when the hardware means is mounted thereto.

14. The pultrusion of claim 9, wherein each pultrusion has disposed therewith at predetermined locations second reinforcing means for mounting hardware means, the second reinforcing means preventing cracking or breaking of the pultrusion proximate the hardware means when the hardware means is mounted thereto.

15. The pultrusion of claim 10, wherein the second reinforcing means is formed in predetermined shapes to compliment the shapes of the at least one portion when the second reinforcing means are affixed therewith.

16. The pultrusion of claim 11, wherein the second reinforcing means is formed in predetermined shapes to compliment the shapes of the at least one portion when the second reinforcing means are affixed therewith.

17. The pultrusion of claim 12, wherein the second reinforcing means is formed in predetermined shapes to compliment the shapes of the at least one portion when the second reinforcing means are affixed therewith.

18. The pultrusion of claim 13, wherein the second reinforcing means is formed in predetermined shapes to compliment the shapes of the at least one portion when the second reinforcing means are affixed therewith.

19. The pultrusion of claim 14, wherein the second reinforcing means is formed in predetermined shapes to compliment the shapes of the at least one portion when the second reinforcing means are affixed therewith.

20. The pultrusion of claim 10, wherein the second reinforcing means includes portions which engage outer flanges of the framing section to stiffen the section and to further provide a flange to fasten the sections within an opening when assembled.

21. The pultrusion of claim 12, wherein the second reinforcing means includes portions which engage outer flanges of the framing section to stiffen the section and to further provide a flange to fasten the sections within an opening when assembled.

22. A closure assembly assembled by fastening means and comprising a first peripheral frame defining an opening within which a closure member is supported, each frame including first and second framing portions, at least one of the first and second framing portions includes at least one framing portion being at least one thin wall fiberglass pultrusion having a predetermined cross section including three surfaces and having at least one complementary butting and engaging portion formed therewith, the wall of the pultrusion being of a predetermined thickness substantially in the range of 10 to 90 thousandths of an inch, each fiberglass pultrusion being fastened to the adjacent pultrusion by first reinforcing means having complementary pultrusion butting and engaging portions disposed therewith compatible in shape with the pultrusion and the at least one complementary butting and engaging portion thereof, said first reinforcing means for reinforcing the framing section in use from cracking or breaking proximate at least three surfaces of said cross section of said pultrusion in at least three planes as fastening means are fastened to the first reinforcing means, the first reinforcing means distributing any fastening stresses tending to locally crack or break the pultrusion adjacent a point of fastening to the first reinforcing means and to a substantially greater cross sectional area than the immediate surrounding surface of the pultrusion proximate the point of fastening the closure member having fastened thereto hardware means, the hardware means being mounted with pultrusions at predetermined locations by providing second reinforcing means to reinforce the fiberglass pultrusion proximate each predetermined location and for mounting the hardware means thereat, while reinforcing the framing section in use from cracking or breaking proximate at least three surfaces of said cross section of said pultrusion in at least three planes as fastening means are fastened to the second reinforcing means, the second reinforcing means distributing any fastening stresses tending to locally crack or break the pultrusion adjacent a point of fastening to the second reinforcing means and to a substantially greater cross sectional area than the immediate surrounding surface of the pultrusion proximate the point of fastening.

23. The closure assembly of claim 22, wherein the second reinforcing means includes portions which engage with flanges on the exterior of pultrusions to reinforce the flanges and further to provide a mounting flange for mounting the closure assembly in said opening.

24. The closure assembly of claim 22, wherein one of the framing portions further comprises in use first reinforcing means being brackets made of nylon having compatibly shaped portions to engage with the at least one groove, channel or flange of the framing portions, thereby connecting adjacent framing portions.

25. The closure assembly of claim 22, wherein the first or second reinforcing means are molded in predetermined positions with some of the pultrusions.

26. The closure assembly of claim 22, wherein the framing portion further comprises in use first reinforcing means being right angled brackets engaged with the at least one groove, channel or flange of the framing portion, thereby squaring the orientation of adjacent framing sections with respect to each other when assembled.

27. The closure assembly of claim 22 wherein a pultrusion forms a sill portion of the closure assembly and further comprises detent portions proximate the edges thereof to engage with detents disposed with supplementary portions to be assembled therewith in use.

28. The closure assembly of claim 27, wherein the pultrusion and the supplementary portions are also connected to reinforcing portions which are affixed to both the pultrusion and the supplementary portions with the portions of the pultrusion formed therewith.

29. The closure assembly of claim 22, further comprising a substantial right angled three-dimensional bracket having two appendages, the appendages for joining adjacent pultrusions proximate the at least one groove, channel or flange thereof.

30. The closure assembly of claim 29, wherein the bracket is manufactured from resilient materials such as fiberglass, plastic, or nylon.

31. The closure assembly of claim 29, wherein the bracket is for insertion within an opening disposed proximate each end of adjacent pultrusions.

32. The closure assembly of claim 30, wherein the bracket is for insertion within an opening disposed proximate each end of adjacent pultrusions.

33. The closure assembly of claim 29, wherein the three-dimensional bracket is moulded from moldable materials having reinforcing portions therewith to provide the necessary strength for connected adjacent pultrusions.

34. The closure assembly of claim 31, wherein the three-dimensional bracket is moulded from materials having reinforcing portions therewith to provide the necessary strength for connected adjacent pultrusions.

35. The closure assembly of claim 22, wherein the hardware means further comprises window opening mechanisms locking portions, or handle portions.

36. The closure assembly of claim 22, wherein the hardware means further comprises mounting brackets for mounting the closure assembly in an opening.

37. The closure assembly of claim 36, wherein the mounting bracket has detent portions which engage and rigidify the pultrusions and a mounting or nailing flange disposed therewith for mounting the closure assembly in an opening.

38. The closure assembly of claim 22 wherein the first reinforcing means further comprises a first portion having compatible shaped portions formed therewith to engage the at least one groove, channel or flange of pultrusions.

39. The closure assembly of claim 28, wherein the first reinforcing means further comprises a first portion having compatible shaped portions formed therewith to engage the at least one portion of the pultrusions.

40. The closure assembly of claim 38, wherein the first portion has disposed therewith first detent portions, to fasten the first portion to the pultrusion, the first portion having second detent portions therewith, to fasten adjacent pultrusions to the first portions and the pultrusion to which it is fastened.

41. The closure assembly of claim 39, wherein the first portion has disposed therewith first detent portions, to fasten the first portion to the pultrusion, the first portion having second detent portions therewith, to fasten adjacent pultrusions to the first portions and the pultrusion to which it is fastened.

42. The closure assembly of claim 40, wherein the first detent portions are substantially C-shaped cylinders for receiving threaded fasteners.

43. The closure assembly of claim 41, wherein the first detent portions are substantially C-shaped cylinders for receiving threaded fasteners.

44. The closure assembly of claim 42, wherein the first detent portions are substantially C-shaped cylinders for receiving threaded fasteners.

45. The closure assembly of claim 38, wherein notches disposed with the pultrusion engage flanges with the first portion when fastened.

46. The closure assembly of claim 40, wherein notches disposed with the pultrusion engage flanges with the first portion when fastened.

47. The closure assembly of claim 44, wherein notches disposed with the pultrusion engage flanges with the first portion when fastened.

48. The closure assembly of claim 44, wherein notches disposed with the pultrusion engage flanges with the first portion when fastened.

49. A closure assembly comprising a first peripheral frame defining an opening within which a moveable closure member is supported, the peripheral frame including first and second framing portions, at least one of the first and second framing portions includes at least one framing portion being at least one thin wall fiberglass pultrusion having at least one detail portion formed therewith, the wall of the pultrusion being of a predetermined thickness, each fiberglass pultrusion being affixed to the adjacent framing portion by first reinforcing means, the closure assembly having affixed thereto hardware means, the hardware means being mounted with pultrusions at predetermined locations by providing second reinforcing means to reinforce the fiberglass pultrusion proximate each predetermined location when mounting the hardware means wherein the framing portion further comprises in use second reinforcing means having a base and at least one appendage extending upwardly away from the base, the appendage being flanges disposed with the base to brace the second reinforcing means in the at least one portion, thus rigidifying the portion.

50. The closure assembly of claim 49, wherein the predetermined thickness of the at least one fiberglass pultrusion is substantially between twenty five to ninety thousandths of an inch.

51. The closure assembly of claim 49, wherein the first or second reinforcing means are molded in predetermined positions with some of the pultrusions.

52. The closure assembly of claim 50, wherein the first or second reinforcing means are molded in predetermined positions with some of the pultrusions.

53. The closure assembly of claim 49, wherein the base has detent means disposed therewith aligned with detent means disposed with the pultrusion for mounting hardware therefor.

54. The closure assembly of claim 50, wherein the base has detent means disposed therewith aligned with detent means disposed with the pultrusion for mounting hardware therefor.

55. The closure assembly of claim 51, wherein the base has detent means disposed therewith aligned with detent means disposed with the pultrusion for mounting hardware therefor.

56. The closure assembly of claim 52, wherein the base has detent means disposed therewith aligned with detent means disposed with the pultrusion for mounting hardware therefor.

57. The closure assembly of claim 49, wherein the base has a coplanar tang extending therefrom to abut the pultrusion in use.

58. The closure assembly of claim 50, wherein the base has a coplanar tang extending therefrom to abut the pultrusion in use.

59. The closure assembly of claim 53, wherein the base has a coplanar tang extending therefrom to abut the pultrusion in use.

60. A closure assembly comprising thin walled fiberglass pultrusions having a predetermined cross section including three surfaces, said pultrusions being of sufficient thickness in use to crack or break if not reinforced and therefore requiring reinforcement proximate the cross section thereof, the pultrusions being reinforced by reinforcement means in three dimensions proximate the cross section adjacent the edge of the pultrusions when the pultrusions are joined to adjacent pultrusions, wherein said reinforcement is provided proximate at least three surfaces of the cross section of the pultrusions and thereby reinforcing the pultrusions in at least three planes.

61. A closure assembly comprising thin walled fiberglass pultrusions having a predetermined cross section including three surfaces, said pultrusions being of sufficient thickness to require reinforcement of the pultrusions in three dimensions proximate the three surfaces of the cross section of the pultrusions adjacent the edge of the pultrusions when the pultrusions are joined to adjacent pultrusions, the pultrusions having complementary portions provided with said predetermined cross section and being of sufficient thickness in use to crack or break if not reinforced proximate the edge thereof and therefore requiring reinforcement proximate at least three surfaces of the cross section thereof, each pultrusion being reinforced by reinforcement means including complementary portions adapted to engage the complementary portions of the pultrusions proximate said at least three surfaces of said cross section of said pultrusion, when the pultrusions are joined to adjacent pultrusion, mounted within an opening for the closure assembly or when hardware is mounted to the pultrusions, the complementary portions of the reinforcement means being compatible in shape with the cross section of the pultrusion and the complementary portions thereof to provide the necessary reinforcing of the closure assembly, wherein reinforcement is provided proximate at least three surfaces of the cross section of the pultrusions reinforcing the pultrusions in at least three planes.

* * * * *